US010012937B2

(12) United States Patent
Yuasa et al.

(10) Patent No.: US 10,012,937 B2
(45) Date of Patent: Jul. 3, 2018

(54) FIXING DEVICE AND IMAGE FORMING APPARATUS INCLUDING A FIXING BELT, A PRESSER, AND A GAP RETAINER

(71) Applicants: Shuutaroh Yuasa, Kanagawa (JP); Keisuke Kubota, Kanagawa (JP); Masami Okamoto, Kanagawa (JP); Seiji Saitoh, Kanagawa (JP); Fumihiro Hirose, Kanagawa (JP); Kensuke Yamaji, Kanagawa (JP); Jun Ogino, Kanagawa (JP); Yuuta Kanda, Kanagawa (JP)

(72) Inventors: Shuutaroh Yuasa, Kanagawa (JP); Keisuke Kubota, Kanagawa (JP); Masami Okamoto, Kanagawa (JP); Seiji Saitoh, Kanagawa (JP); Fumihiro Hirose, Kanagawa (JP); Kensuke Yamaji, Kanagawa (JP); Jun Ogino, Kanagawa (JP); Yuuta Kanda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/452,877

(22) Filed: Mar. 8, 2017

(65) Prior Publication Data

US 2017/0269526 A1 Sep. 21, 2017

(30) Foreign Application Priority Data

Mar. 18, 2016 (JP) ..... 2016-055965
Aug. 30, 2016 (JP) ..... 2016-168221

(51) Int. Cl.
*G03G 15/20* (2006.01)

(52) U.S. Cl.
CPC ..... *G03G 15/2089* (2013.01); *G03G 15/2017* (2013.01); *G03G 15/2032* (2013.01);
(Continued)

(58) Field of Classification Search
CPC ..... G03G 15/2089; G03G 15/2032
See application file for complete search history.

(56) References Cited

U.S. PATENT DOCUMENTS 7,167,670 B2 * 1/2007 Obata ..... G03G 15/2064 219/216
9,316,979 B2 * 4/2016 Nozawa ..... G03G 15/2085
(Continued)

FOREIGN PATENT DOCUMENTS

JP 3-133871 6/1991
JP 2003-005566 1/2003
(Continued)

*Primary Examiner* — G. M. Hyder
(74) *Attorney, Agent, or Firm* — Oblon, McClelland, Maier & Neustadt, L.L.P.

(57) ABSTRACT

A fixing device includes a fixing belt that is endless and rotatable in a rotation direction and a nip former stretching the fixing belt. A pressure rotator presses against the nip former via the fixing belt to form a fixing nip between the fixing belt and the pressure rotator, through which a recording medium is conveyed. A presser is disposed downstream from an exit of the fixing nip in a recording medium conveyance direction. The presser brings the fixing belt into contact with the pressure rotator. A gap retainer contacts the nip former and is coupled to the presser to retain isolation of the presser from the nip former.

20 Claims, 8 Drawing Sheets

(52) U.S. Cl.
CPC . *G03G 15/2028* (2013.01); *G03G 2215/0129* (2013.01); *G03G 2215/2032* (2013.01); *G03G 2215/2041* (2013.01)

(56) References Cited

U.S. PATENT DOCUMENTS

| | | | | |
|---|---|---|---|---|
| 9,733,600 | B2 * | 8/2017 | Nozawa | G03G 15/2053 |
| 2002/0051659 | A1 * | 5/2002 | Baba | G03G 15/161 399/307 |
| 2003/0103788 | A1 * | 6/2003 | Yura | G03G 15/2064 399/329 |
| 2005/0111862 | A1 * | 5/2005 | Fuma | G03G 15/2064 399/67 |
| 2007/0048042 | A1 * | 3/2007 | Uehara | G03G 15/2028 399/329 |
| 2007/0172272 | A1 * | 7/2007 | Miyata | G03G 15/2064 399/329 |
| 2011/0164904 | A1 | 7/2011 | Hirose et al. | |
| 2011/0217091 | A1 | 9/2011 | Hirose et al. | |
| 2011/0222926 | A1 | 9/2011 | Ueno et al. | |
| 2011/0229201 | A1 | 9/2011 | Yamada | |
| 2012/0014725 | A1 | 1/2012 | Seto et al. | |
| 2012/0044516 | A1 | 2/2012 | Hirose et al. | |
| 2012/0207523 | A1 | 8/2012 | Ueno et al. | |
| 2012/0224893 | A1 | 9/2012 | Yamamoto et al. | |
| 2013/0170877 | A1 | 7/2013 | Yoshiura et al. | |
| 2013/0189005 | A1 | 7/2013 | Saito et al. | |
| 2013/0209147 | A1 | 8/2013 | Ogawa et al. | |
| 2013/0236225 | A1 | 9/2013 | Ogawa et al. | |
| 2013/0294802 | A1 | 11/2013 | Yamamoto et al. | |
| 2014/0270865 | A1 | 9/2014 | Yamaji et al. | |
| 2015/0063882 | A1 * | 3/2015 | Nakano | G03G 15/2053 399/329 |
| 2015/0168897 | A1 | 6/2015 | Ogawa et al. | |
| 2015/0261154 | A1 * | 9/2015 | Nozawa | G03G 15/2085 399/323 |
| 2017/0269522 | A1 * | 9/2017 | Kubota | G03G 15/2085 |

FOREIGN PATENT DOCUMENTS

| | | |
|---|---|---|
| JP | 2007-065092 | 3/2007 |
| JP | 2008-134356 | 6/2008 |
| JP | 2011-123199 | 6/2011 |
| JP | 2011-123200 | 6/2011 |
| JP | 2011-215612 | 10/2011 |
| JP | 2014-178563 | 9/2014 |
| JP | 2015-172620 | 10/2015 |

* cited by examiner

FIXING DEVICE AND IMAGE FORMING APPARATUS INCLUDING A FIXING BELT, A PRESSER, AND A GAP RETAINER

CROSS-REFERENCE TO RELATED APPLICATIONS

This patent application is based on and claims priority pursuant to 35 U.S.C. § 119 to Japanese Patent Application Nos. 2016-055965, filed on Mar. 18, 2016, and 2016-168221, filed on Aug. 30, 2016, in the Japanese Patent Office, the entire disclosure of each of which is hereby incorporated by reference herein.

BACKGROUND

Technical Field

Exemplary aspects of the present disclosure relate to a fixing device and an image forming apparatus, and more particularly, to a fixing device for fixing a toner image on a recording medium and an image forming apparatus incorporating the fixing device.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and a pressure rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the pressure rotator apply heat and pressure to the recording medium, melting and fixing the toner image on the recording medium.

SUMMARY

This specification describes below an improved fixing device. In one exemplary embodiment, the fixing device includes a fixing belt that is endless and rotatable in a rotation direction and a nip former stretching the fixing belt. A pressure rotator presses against the nip former via the fixing belt to form a fixing nip between the fixing belt and the pressure rotator, through which a recording medium is conveyed. A presser is disposed downstream from an exit of the fixing nip in a recording medium conveyance direction. The presser brings the fixing belt into contact with the pressure rotator. A gap retainer contacts the nip former and is coupled to the presser to retain isolation of the presser from the nip former.

This specification further describes an improved image forming apparatus. In one exemplary embodiment, the image forming apparatus includes an image forming device to form a toner image and a fixing device disposed downstream from the image forming device in a recording medium conveyance direction to fix the toner image on a recording medium. The fixing device includes a fixing belt that is endless and rotatable in a rotation direction and a nip former stretching the fixing belt. A pressure rotator presses against the nip former via the fixing belt to form a fixing nip between the fixing belt and the pressure rotator, through which the recording medium is conveyed. A presser is disposed downstream from an exit of the fixing nip in the recording medium conveyance direction. The presser brings the fixing belt into contact with the pressure rotator. A gap retainer contacts the nip former and is coupled to the presser to retain isolation of the presser from the nip former.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
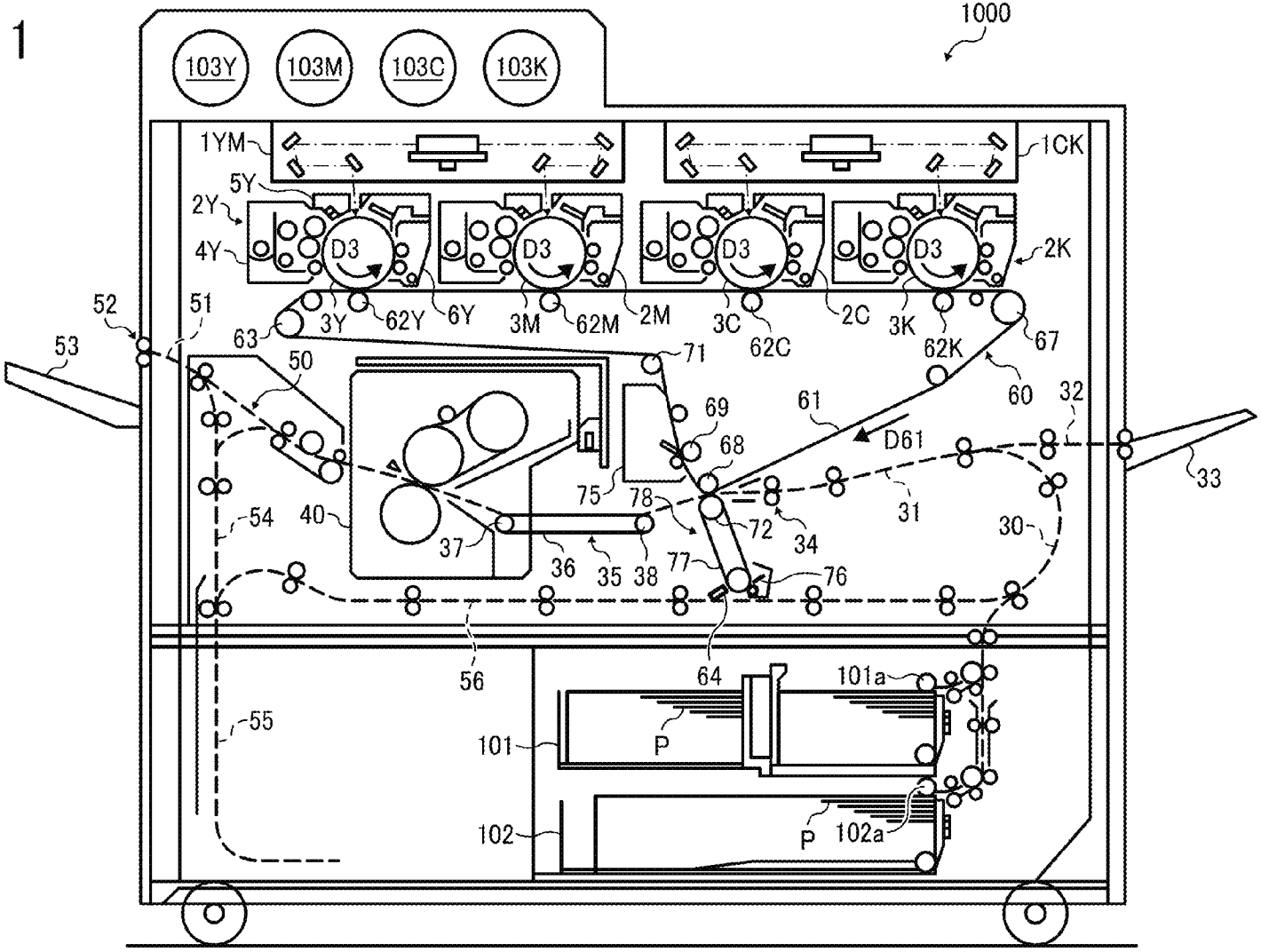
FIG. 1 is a schematic vertical cross-sectional view of an image forming apparatus according to an exemplary embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION OF THE DISCLOSURE

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring now to the drawings, wherein like reference numerals designate identical or corresponding parts throughout the several views, particularly to FIG. 1, an image forming apparatus 1000 according to an exemplary embodiment is explained.

FIG. 1 is a schematic vertical cross-sectional view of the image forming apparatus 1000. The image forming apparatus 1000 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1000 is a color printer that forms color and monochrome toner images on a recording medium by electrophotography. Alternatively, the image forming apparatus 1000 may be a monochrome printer that forms a monochrome toner image on a recording medium.

Referring to FIG. 1, a description is provided of a construction of the image forming apparatus 1000.

The image forming apparatus 1000 includes four image forming units 2Y, 2M, 2C, and 2K that form yellow (Y), magenta (M), cyan (C), and black (K) toner images, respectively. The image forming apparatus 1000 employs a tandem system in which the four image forming units 2Y, 2M, 2C, and 2K are aligned in a rotation direction D61 of an intermediate transfer belt 61 serving as an endless belt that bears toner images as described below.

The image forming apparatus 1000 further includes a feeding path 30, a pre-transfer conveyance path 31, a bypass feeding path 32, a bypass tray 33, a registration roller pair 34, a conveyance belt unit 35, a fixing device 40, a conveyance switch device 50, an output path 51, an output roller pair 52, and an output tray 53. The image forming apparatus 1000 further includes two optical writing units 1YM and 1CK, a primary transfer unit 60, a secondary transfer unit 78, a first paper tray 101, and a second paper tray 102.

The image forming units 2Y, 2M, 2C, and 2K include drum-shaped photoconductors 3Y, 3M, 3C, and 3K, respectively, each of which serves as a latent image bearer that bears an electrostatic latent image. Each of the first paper tray 101 and the second paper tray 102 accommodates a sheaf of sheets P serving as a plurality of recording media. As one of feeding rollers 101*a* and 102*a* is driven and rotated selectively, the one of the feeding rollers 101*a* and 102*a* feeds an uppermost sheet P of the sheaf of sheets P toward the feeding path 30.

The bypass tray 33 is attached to a side face of a body of the image forming apparatus 1000 such that the bypass tray 33 is opened and closed relative to the body. A user opens the bypass tray 33 relative to the body of the image forming apparatus 1000 and places a sheaf of sheets P on a top face of the bypass tray 33. A feeding roller attached to the bypass tray 33 feeds an uppermost sheet P of the sheaf of sheets P placed on the bypass tray 33 toward the feeding path 30.

A detailed description is now given of a construction of the two optical writing units 1YM and 1CK.

Each of the two optical writing units 1YM and 1CK includes a laser diode, a polygon mirror, and various lenses. The optical writing units 1YM and 1CK drive the laser diodes according to image data created by a scanner separately provided from the image forming apparatus 1000 as the scanner reads an image or image data sent from a client computer. The laser diodes emit laser beams that optically scan the photoconductors 3Y, 3M, 3C, and 3K of the image forming units 2Y, 2M, 2C, and 2K, respectively. For example, a driver drives and rotates the photoconductors 3Y, 3M, 3C, and 3K of the image forming units 2Y, 2M, 2C, and 2K, respectively, counterclockwise in FIG. 1 in a rotation direction D3. The optical writing unit 1YM emits a laser beam onto each of the photoconductors 3Y and 3M rotating in the rotation direction D3 while deflecting the laser beam in an axial direction of each of the photoconductors 3Y and 3M, thus performing an optical scanning process. Thus, an electrostatic latent image is formed on each of the photoconductors 3Y and 3M according to yellow and magenta image data, respectively. Similarly, the optical writing unit 1CK emits a laser beam onto each of the photoconductors 3C and 3K rotating in the rotation direction D3 while deflecting the laser beam in an axial direction of each of the photoconductors 3C and 3K, thus performing an optical scanning process. Thus, an electrostatic latent image is formed on each of the photoconductors 3C and 3K according to cyan and black image data, respectively.

A detailed description is now given of a construction of the image forming units 2Y, 2M, 2C, and 2K.

The image forming units 2Y, 2M, 2C, and 2K include the photoconductors 3Y, 3M, 3C, and 3K, serving as latent image bearers, and various devices surrounding the photoconductors 3Y, 3M, 3C, and 3K, which are formed into four units, respectively. Each of the four units is supported by a common support and detachably attached to the body of the image forming apparatus 1000. The four image forming units 2Y, 2M, 2C, and 2K have a substantially identical construction except for the color (e.g., yellow, magenta, cyan, and black) of toner used in the image forming units 2Y, 2M, 2C, and 2K. Taking the image forming unit 2Y that forms a yellow toner image, for example, the image forming unit 2Y includes a developing device 4Y in addition to the photoconductor 3Y. The developing device 4Y supplies yellow toner to the electrostatic latent image formed on an outer circumferential surface of the photoconductor 3Y, thus developing the electrostatic latent image into the yellow toner image. The image forming unit 2Y further includes a charger 5Y and a drum cleaner 6Y. The charger 5Y uniformly charges the outer circumferential surface of the photoconductor 3Y while the photoconductor 3Y is driven and rotated. After the yellow toner image formed on the photoconductor 3Y passes through a primary transfer nip described below, the drum cleaner 6Y removes residual toner failed to be transferred onto the intermediate transfer belt 61 and therefore remaining on the outer circumferential surface of the photoconductor 3Y therefrom.

The photoconductor 3Y is a drum constructed of an element tube made of aluminum or the like and a photosensitive layer coating the element tube and being made of an organic sensitive material having photosensitivity. Alternatively, the photoconductor 3Y may be an endless belt instead of the drum.

The developing device 4Y includes a developing sleeve and a magnet roller. The developing sleeve is rotatable and made of a non-magnetic pipe. The magnet roller is disposed in a hollow of the developing sleeve such that the magnet roller does not rotate in accordance with rotation of the developing sleeve. The magnet roller generates a magnetic force that develops the electrostatic latent image formed on the photoconductor 3Y with a two-component developer (hereinafter referred to as a developer), containing magnetic carrier particles and non-magnetic yellow toner particles, which is supplied onto an outer circumferential surface of the developing sleeve. A potential difference between a potential of a developing bias applied to the developing sleeve and a potential of the electrostatic latent image formed on the photoconductor 3Y applies a developing potential to the yellow toner particles on the developing sleeve, which are disposed opposite the electrostatic latent image formed on the photoconductor 3Y. Conversely, a potential difference between the potential of the developing bias and a potential of a background portion on the photoconductor 3Y applies a background potential to the yellow toner particles on the developing sleeve, which are disposed opposite the background portion on the photoconductor 3Y. The developing potential and the background potential selectively adhere the yellow toner particles on the developing sleeve to the electrostatic latent image on the photoconductor 3Y, not to the background portion, thus developing the electrostatic latent image into the yellow toner image.

A yellow toner supply device supplies yellow toner, that is, yellow toner particles, contained in a yellow toner bottle 103Y to the developing device 4Y in a proper amount. A toner density sensor serving as a toner density detector is disposed in the developing device 4Y. The toner density sensor detects a magnetic permeability of the developer that is caused by carrier particles as a magnetic material. A main controller described below controls driving of the yellow toner supply device based on a comparison between an output value output by the toner density sensor and a target output value, that is, a target toner density value, output by the toner density sensor, thus adjusting a density of toner contained in the developer within a predetermined range (e.g., a range of from 4 weight percent to 9 weight percent). Similarly, the main controller controls driving of a magenta toner supply device, a cyan toner supply device, and a black toner supply device that supply magenta toner, cyan toner, and black toner supplied from a magenta toner bottle 103M, a cyan toner bottle 103C, and a black toner bottle 103K to developing devices of the image forming units 2M, 2C, and 2K, respectively.

The drum cleaner 6Y includes a cleaning blade made of polyurethane rubber. The cleaning blade contacts the photoconductor 3Y to scrape residual toner failed to be transferred onto the intermediate transfer belt 61 and therefore remaining on the photoconductor 3Y from the outer circumferential surface of the photoconductor 3Y. Alternatively, the drum cleaner 6Y may employ other cleaning method. In order to enhance cleaning performance, the drum cleaner 6Y includes a rotatable fur brush that contacts the photoconductor 3Y in addition to the cleaning blade. The fur brush also scrapes a fine, powdery lubricant off a solid lubricant and applies the fine, powdery lubricant to the outer circumferential surface of the photoconductor 3Y.

Above the photoconductor 3Y is a discharge lamp. The discharge lamp is a part of the image forming unit 2Y. The discharge lamp is disposed downstream from the drum cleaner 6Y in the rotation direction D3 of the photoconductor 3Y and discharges the outer circumferential surface of the photoconductor 3Y by optical illumination. The charger 5Y uniformly charges the discharged outer circumferential surface of the photoconductor 3Y. Thereafter, the optical writing unit 1YM performs optical scanning as described above. The charger 5Y is driven and rotated while the charger 5Y receives a charging bias from a power supply. Alternatively, the charger 5Y may employ a scorotron charger that charges the photoconductor 3Y without contacting the photoconductor 3Y.

The above describes the construction of the image forming unit 2Y that forms the yellow toner image. Each of the image forming units 2M, 2C, and 2K that form the magenta, cyan, and black toner images, respectively, has a construction similar to the construction of the image forming unit 2Y.

A detailed description is now given of a construction of the primary transfer unit 60.

Below the four image forming units 2Y, 2M, 2C, and 2K is the primary transfer unit 60. The primary transfer unit 60 includes the intermediate transfer belt 61 serving as an image bearer stretched taut across a plurality of rollers (e.g., rollers 63, 67, 69, and 71). While the intermediate transfer belt 61 contacts the photoconductors 3Y, 3M, 3C, and 3K, one of the plurality of rollers is driven and rotated to rotate the intermediate transfer belt 61 clockwise in FIG. 1 in the rotation direction D61. Accordingly, four primary transfer nips are formed between the four photoconductors 3Y, 3M, 3C, and 3K and the intermediate transfer belt 61, respectively. At the primary transfer nips, the yellow, magenta, cyan, and black toner images formed on the photoconductors 3Y, 3M, 3C, and 3K, respectively, are primarily transferred onto the intermediate transfer belt 61.

In proximity to the four primary transfer nips are primary transfer rollers 62Y, 62M, 62C, and 62K disposed inside a loop formed by the intermediate transfer belt 61. The primary transfer rollers 62Y, 62M, 62C, and 62K press the intermediate transfer belt 61 against the photoconductors 3Y, 3M, 3C, and 3K, respectively. A primary transfer power supply applies a primary transfer bias to each of the primary transfer rollers 62Y, 62M, 62C, and 62M. Accordingly, a primary transfer electric field that electrostatically transfers the yellow, magenta, cyan, and black toner images formed on the photoconductors 3Y, 3M, 3C, and 3K, respectively, onto the intermediate transfer belt 61 is produced at each of the four primary transfer nips.

As the intermediate transfer belt 61 rotates clockwise in FIG. 1 in the rotation direction D61 and passes through the four primary transfer nips successively, the yellow, magenta, cyan, and black toner images formed on the four photoconductors 3Y, 3M, 3C, and 3K, respectively, are primarily transferred onto an outer circumferential surface of the intermediate transfer belt 61 at the four primary transfer nips successively such that the yellow, magenta, cyan, and black toner images are superimposed on a same position on the intermediate transfer belt 61. Accordingly, the outer circumferential surface of the intermediate transfer belt 61 bears the yellow, magenta, cyan, and black toner images superimposed thereon.

A detailed description is now given of a construction of the secondary transfer unit 78.

Below the intermediate transfer belt 61 is the secondary transfer unit 78. The secondary transfer unit 78 includes an endless, secondary transfer belt 77, a grounded driven roller 72, a driving roller, a secondary transfer belt cleaner 76, and a toner adhesion amount sensor 64. The secondary transfer belt 77 is stretched taut across the grounded driven roller 72 and the driving roller that are disposed inside a loop formed by the secondary transfer belt 77. As the driving roller is driven and rotated, the driving roller rotates the secondary transfer belt 77 counterclockwise in FIG. 1.

The secondary transfer belt 77 of the secondary transfer unit 78 at a looped position where the secondary transfer belt 77 is looped over the grounded driven roller 72 contacts the intermediate transfer belt 61 of the primary transfer unit 60 at a looped position where the intermediate transfer belt 61 is looped over a secondary transfer bias roller 68, thus forming a secondary transfer nip between the intermediate transfer belt 61 and the secondary transfer belt 77. The secondary transfer bias roller 68 disposed inside the loop formed by the intermediate transfer belt 61 is applied with a secondary transfer bias output by a secondary transfer power supply described below. Conversely, the grounded driven roller 72 disposed inside the loop formed by the secondary transfer belt 77 is grounded. Accordingly, a secondary transfer electric field is created at the secondary transfer nip.

On the right of the secondary transfer nip in FIG. 1 is the registration roller pair 34 that feeds the sheet P sandwiched between two rollers of the registration roller pair 34 to the secondary transfer nip at a time when the yellow, magenta, cyan, and black toner images superimposed on the intermediate transfer belt 61 reach the secondary transfer nip. At the secondary transfer nip, the yellow, magenta, cyan, and black toner images superimposed on the intermediate transfer belt 61 are secondarily transferred onto the sheet P collectively under the secondary transfer electric field and pressure. Thus, the transferred, yellow, magenta, cyan, and black toner images form a full color toner image with a white background on the sheet P.

After passing through the secondary transfer nip, the outer circumferential surface of the intermediate transfer belt 61 is adhered with residual toner failed to be secondarily transferred onto the sheet P. An intermediate transfer belt cleaner 75 of the primary transfer unit 60 removes the residual toner from the outer circumferential surface of the intermediate transfer belt 61.

A detailed description is now given of a construction of the conveyance belt unit 35.

After passing through the secondary transfer nip, the sheet P is separated from the intermediate transfer belt 61 and the secondary transfer belt 77 and is delivered to the conveyance belt unit 35. The conveyance belt unit 35 includes a driving roller 37, a driven roller 38, and an endless, conveyance belt 36 stretched taut across the driving roller 37 and the driven roller 38. As the driving roller 37 is driven and rotated, the driving roller 37 rotates the conveyance belt 36 counterclockwise in FIG. 1. While an upper stretched face of the conveyance belt 36 carries the sheet P delivered from the secondary transfer nip, the conveyance belt 36 delivers the sheet P to the fixing device 40 as the conveyance belt 36 rotates counterclockwise in FIG. 1.

A detailed description is now given of a construction of the fixing device 40.

The sheet P sent to the fixing device 40 is sandwiched between an endless, fixing belt and a pressure roller at a fixing nip formed between the fixing belt and the pressure roller. The fixing belt and the pressure roller fix the full color toner image on a surface of the sheet P under heat and pressure.

A detailed description is now given of a construction of the conveyance switch device 50.

The sheet P secondarily transferred with the full color toner image on a first side of the sheet P at the secondary transfer nip and fixed with the full color toner image on the first side of the sheet P by the fixing device 40 is sent to the conveyance switch device 50. The image forming apparatus 1000 includes the conveyance switch device 50, a refeeding path 54, a switch-back path 55, and a post switch-back conveyance path 56, which construct a refeeder. The conveyance switch device 50 switches destination of the sheet P received from the fixing device 40 between the output path 51 and the refeeding path 54.

For example, if the image forming apparatus 1000 receives a one-sided print job to form a toner image on the first side of the sheet P, the conveyance switch device 50 directs the sheet P to the output path 51. The conveyance switch device 50 sends the sheet P bearing the toner image on the first side of the sheet P to the output roller pair 52 through the output path 51. The output roller pair 52 ejects the sheet P onto the output tray 53 disposed outside the body of the image forming apparatus 1000. If the image forming apparatus 1000 receives a two-sided print job to form a toner image on both sides, that is, the first side and a second side, of the sheet P, the conveyance switch device 50 directs the sheet P bearing the toner image on both sides of the sheet P to the output path 51 as the conveyance switch device 50 receives the sheet P from the fixing device 40. The conveyance switch device 50 sends the sheet P bearing the toner image on both sides of the sheet P to the output tray 53 disposed outside the body of the image forming apparatus 1000.

Conversely, if the image forming apparatus 1000 receives a two-sided print job to form a toner image on both sides of the sheet P, the conveyance switch device 50 directs the sheet P bearing the toner image on the first side of the sheet P to the refeeding path 54 as the conveyance switch device 50 receives the sheet P bearing the toner image on the first side on the sheet P from the fixing device 40. Since the refeeding path 54 is coupled to the switch-back path 55, the sheet P sent to the refeeding path 54 enters the switch-back path 55. When the sheet P enters the switch-back path 55 entirely in a sheet conveyance direction, the switch-back path 55 reverses the sheet conveyance direction of the sheet P to switch back the sheet P. Since the post switch-back conveyance path 56, in addition to the refeeding path 54, is coupled to the switch-back path 55, the sheet P that is switched back enters the post switch-back conveyance path 56. Accordingly, the sheet P is reversed. The reversed sheet P is resent to the secondary transfer nip through the post switch-back conveyance path 56 and the feeding path 30. The sheet P secondarily transferred with another toner image on the second side of the sheet P at the secondary transfer nip is sent to the fixing device 40 where the another toner image is fixed on the second side of the sheet P. Thereafter, the sheet P bearing the fixed toner image is ejected onto the output tray 53 through the conveyance switch device 50, the output path 51, and the output roller pair 52.

A description is provided of a construction of the fixing device 40 incorporated in the image forming apparatus 1000 having the construction described above.

Figure 2:
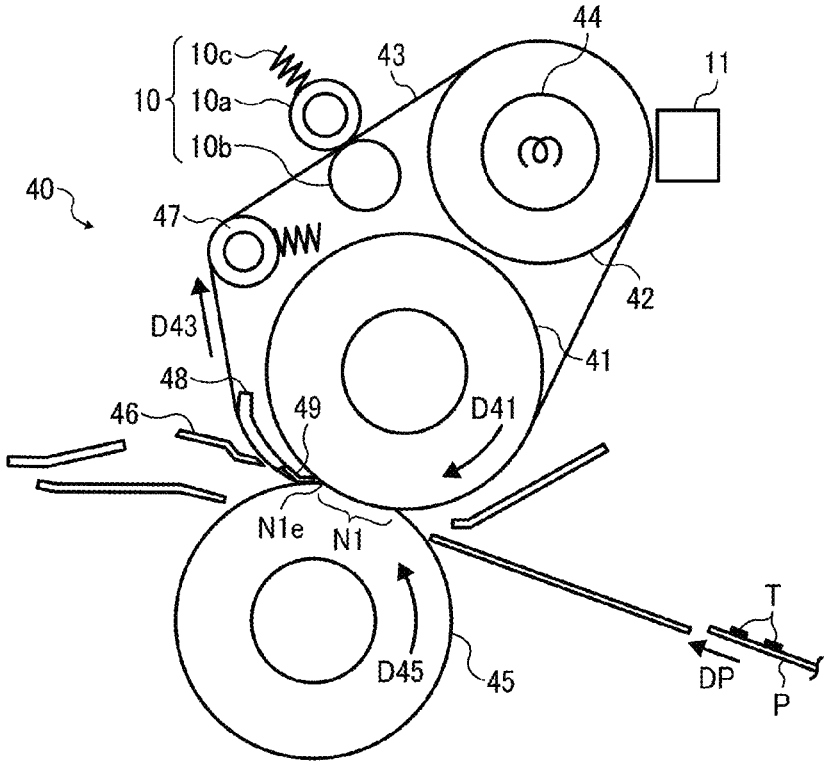
FIG. 2 is a vertical cross-sectional view of a fixing device incorporated in the image forming apparatus depicted in FIG. 1.

FIG. 2 is a schematic vertical cross-sectional view of the fixing device 40. As illustrated in FIG. 2, the fixing device 40 (e.g., a fuser or a fusing unit) employs a belt fixing system and includes a fixing belt 43 rotatable in a rotation direction D43 and a pressure roller serving as a pressure rotator disposed opposite the fixing belt 43 and rotatable in a rotation direction D45. The fixing belt 43 is stretched taut across a fixing roller 41, a heating roller 42, a tension roller 47, and the like. A shaft of each of the fixing roller 41, the heating roller 42, and the pressure roller 45 is rotatably mounted on a frame of the fixing device 40 and extends in a longitudinal direction of the frame of the fixing device 40.

A detailed description is now given of a construction of the fixing belt 43.

The fixing belt 43 is an endless belt constructed of a polyimide (PI) layer and an outer circumferential surface layer coating the PI layer and being made of an offset inhibitor such as tetrafluoroethylene-perfluoroalkylvinylether copolymer (PFA) film. Each of the fixing roller 41 and the pressure roller 45 is a rubber roller. As the pressure roller 45 is pressed against the fixing roller 41 radially via the fixing belt 43, a fixing nip N1 is formed between the pressure roller 45 and the fixing belt 43. The tension roller 47 places tension to the fixing belt 43. The tension roller 47 includes an aluminum tube that is tubular or cylindrical.

A detailed description is now given of a construction of the pressure roller 45.

The pressure roller 45 separably contacts the fixing belt 43. While a sheet P is conveyed through the fixing device 40 for a fixing job, a pressurization assembly presses the pressure roller 45 against the fixing belt 43 to form the fixing nip N1 therebetween. Conversely, while the fixing device 40 is in a standby mode to wait for the fixing job, the pressurization assembly releases pressure exerted to the pressure roller 45 to separate the pressure roller 45 from the fixing belt 43.

A detailed description is now given of a construction of the heating roller 42.

The heating roller 42 is a hollow roller being made of aluminum or iron and accommodating a heater 44 (e.g., a halogen heater) serving as a heater or a heat source. Alternatively, the heater 44 may be an induction heater (IH). A thermistor 11 (e.g., a temperature sensor element) is disposed opposite the heating roller 42 via the fixing belt 43. The heater 44 is controlled based on a temperature of the fixing belt 43 that is detected by the thermistor 11 so that the heater 44 heats the fixing belt 43 to a target temperature.

A detailed description is now given of a configuration of the fixing roller 41.

A driver (e.g., a motor and a reduction gear train) is coupled to the fixing roller 41 to drive and rotate the fixing roller 41 clockwise in FIG. 2 in a rotation direction D41. As the fixing roller 41 rotates in the rotation direction D41, the fixing roller 41 frictionally rotates the fixing belt 43 clockwise in FIG. 2 in the rotation direction D43 and the pressure roller 45 pressed against the fixing roller 41 via the fixing belt 43 counterclockwise in FIG. 2 in the rotation direction D45 at an identical rotation speed. Alternatively, the driver may be coupled to the pressure roller 45 to drive and rotate the pressure roller 45 which rotates the fixing belt 43 pressed by the pressure roller 45 and the fixing roller 41 in accordance with rotation of the pressure roller 45.

A description is provided of a construction of a polisher 10 incorporated in the fixing device 40.

The polisher 10 is interposed between the tension roller 47 and the heating roller 42 in the rotation direction D43 of the fixing belt 43. The polisher 10 polishes an outer circumferential surface of the fixing belt 43. The polisher 10 includes a polishing roller 10*a*, an opposed roller 10*b*, and a spring 10*c*. The polishing roller 10*a* contacts the outer circumferential surface of the fixing belt 43. The opposed roller 10*b* is disposed opposite the polishing roller 10*a* via the fixing belt 43. The spring 10*c* presses the polishing roller 10*a* against the fixing belt 43. Each of the polishing roller 10*a* and the opposed roller 10*b* comes into contact with and separates from the fixing belt 43. While the polishing roller 10*a* is not requested to polish the fixing belt 43, the polishing roller 10*a* and the opposed roller 10*b* are separated from the fixing belt 43 to extend the life of the fixing belt 43.

While the sheet P is conveyed through the fixing nip N1, burrs produced on the sheet P by cutting may scratch and damage the outer circumferential surface of the fixing belt 43, resulting in abrasion of the fixing belt 43. Accordingly, abrasion of an inboard span of the fixing belt 43 that corresponds to a width of a frequently used size sheet P in an axial direction of the fixing belt 43 is different from abrasion of an outboard span of the fixing belt 43 that is outboard from the inboard span in the axial direction of the fixing belt 43. Consequently, while a large sheet P having a width greater than the width of the frequently used size sheet P in the axial direction of the fixing belt 43 is conveyed over the fixing belt 43, since the large sheet P is conveyed over the outboard span of the fixing belt 43, abrasion of the outboard span of the fixing belt 43 may damage a toner image T on the large sheet P. To address this circumstance, according to this exemplary embodiment, the polishing roller 10*a* of the polisher 10 polishes the outer circumferential surface of the fixing belt 43, evening abrasion of the fixing belt 43 in the axial direction thereof and thereby preventing the fixing belt 43 from damaging the toner image T on the sheet P.

A description is provided of a configuration of a separation aid 48 incorporated in the fixing device 40.

The separation aid 48 serving as a first separator is disposed inside a loop formed by the fixing belt 43 and disposed downstream from the fixing nip N1 in the rotation direction D43 of the fixing belt 43. For example, the separation aid 48 is made of metal such as SUS stainless steel and a rigid body such as resin. The separation aid 48 is a curved block or a substantially arcuate block in cross-section. The separation aid 48 contacts an inner circumferential surface of the fixing belt 43 at a downstream position disposed downstream from the fixing nip N1 in the rotation direction D43 of the fixing belt 43. The fixing belt 43 is looped over the separation aid 48 such that the separation aid 48 stretches the fixing belt 43 in a separation direction in which the fixing belt 43 separates from the fixing roller 41 to change the rotation direction D43 of the fixing belt 43 sharply. For example, the separation aid 48 changes the rotation direction D43 of the fixing belt 43 sharply to increase a curvature of the fixing belt 43 and decrease a radius of curvature of the fixing belt 43. The increased curvature of the fixing belt 43 facilitates separation of the sheet P, improving separation performance of the fixing device 40.

The separation aid 48 includes an arcuate contact face that contacts the fixing belt 43. The fixing belt 43 slides over the arcuate contact face of the separation aid 48 smoothly.

The separation aid 48 further includes an arcuate opposed face that is disposed opposite the fixing roller 41 and curved along an outer circumferential surface of the fixing roller 41. Accordingly, the separation aid 48 is disposed inside a limited space inside the loop formed by the fixing belt 43 without contacting the fixing roller 41.

The separation aid 48 extends in an axial direction of the fixing roller 41 throughout the entire span of the fixing roller 41 in the axial direction thereof. Both lateral ends of the separation aid 48 in the axial direction of the fixing roller 41 are mounted on or secured to side faces of the frame of the fixing device 40, respectively. The separation aid 48 does not press against the pressure roller 45, enhancing durability of the pressure roller 45 and preventing a torque of the motor from increasing.

A description is provided of a configuration of a separation plate 46 and a presser 49 incorporated in the fixing device 40.

The separation plate 46 serving as a second separator is disposed opposite the separation aid 48 via the fixing belt 43. A front end of the separation plate 46 is disposed opposite the fixing belt 43 with a slight interval therebetween. The front end of the separation plate 46 is tapered off and has a sharp edge. The presser 49 is interposed between the fixing nip N1 and the separation aid 48 in the rotation direction D43 of the fixing belt 43 and in contact with the inner circumferential surface of the fixing belt 43. The presser 49 presses the fixing belt 43 against the pressure roller 45.

A description is provided of a fixing operation of the fixing device 40 to fix a toner image T on a sheet P.

As the sheet P bearing the toner image T is conveyed through the fixing nip N1, toner of the toner image T is melted and fixed on the sheet P under heat and pressure. The separation plate 46 and the like disposed downstream from an exit N1*e* of the fixing nip N1 in a sheet conveyance direction DP separate or peel the sheet P from the fixing belt 43. Thereafter, the sheet P is ejected from the fixing device 40. An ejection sensor is disposed in proximity to an exit of the fixing device 40 to detect that the sheet P has passed through the fixing nip N1 at a predetermined time. If the ejection sensor does not detect that the sheet P has passed through the fixing nip N1 at the predetermined time, the main controller determines that the sheet P is jammed at the fixing nip N1 and activates a jam handling mode in which the main controller notifies the user to remove the jammed sheet P from the fixing device 40.

A description is provided of a construction of a comparative fixing device 40C.

Figure 3:
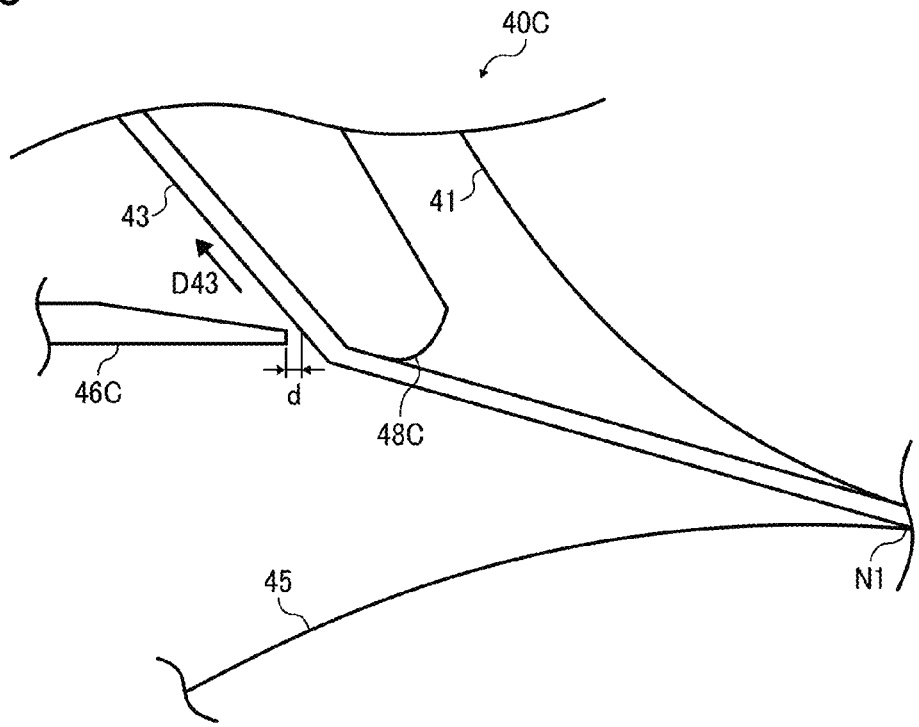
FIG. 3 is a partially enlarged, vertical cross-sectional view of a comparative fixing device.

FIG. 3 is a partially enlarged, vertical cross-sectional view of the comparative fixing device 40C, illustrating the exit N1*e* of the fixing nip N1. The comparative fixing device 40C includes a separation plate 46C that separates a sheet P from the fixing belt 43. For example, when a leading edge of a soft, thin sheet P such as thin paper that is not separated from the fixing belt 43 easily with the curvature of the fixing belt 43 comes into contact with a front edge of the separation plate 46C, the separation plate 46C separates the thin sheet P from the fixing belt 43. If the front edge of the separation plate 46C contacts the fixing belt 43, the separation plate 46C may shave the fixing belt 43, shortening the life of the fixing belt 43. In order to prohibit the front edge of the separation plate 46C from contacting the fixing belt 43 and allow the thin sheet P to come into contact with the separation plate 46C precisely, an interval d of about 0.2 mm between the fixing belt 43 and the separation plate 46C is requested to be retained precisely.

To address this request, a separation aid 48C disposed opposite the separation plate 46C via the fixing belt 43 is made of a rigid body to suppress change in the interval d between the fixing belt 43 and the separation plate 46C due to deformation of the separation aid 48C. If the separation aid 48C made of the rigid body presses against the pressure roller 45 via the fixing belt 43, the separation aid 48C may be deformed resiliently by pressure from the pressure roller 45, resulting in change in the interval d between the fixing belt 43 and the separation plate 46C. Further, the durability of the pressure roller 45 may decrease. As illustrated in Table 1 below, that indicates a result of a durability test of the pressure roller 45 and the fixing belt 43, if the separation aid 48C is retracted from the pressure roller 45 by a length of 2 mm, the separation aid 48C substantially doubles the life of the pressure roller 45 and the fixing belt 43.

TABLE 1

| Separation aid | Pressure roller | Fixing belt |
|---|---|---|
| Pressing against pressure roller with engagement of 0.5 mm | 600 kp | 600 kp |
| Pressing against pressure roller with engagement of 0 mm | 750 kp | 750 kp |
| Retracting from pressure roller by length of 2 mm | 1,400 kp | 1,400 kp |

However, since the separation aid 48C is spaced apart from the pressure roller 45, the sheet P adhered to the fixing belt 43 is not exerted with pressure from the pressure roller 45 in a separation span of the fixing belt 43 that is defined from a nip position disposed opposite the fixing nip N1 to a separation position disposed opposite the front edge of the separation plate 46C. As the sheet P is heated by the fixing belt 43 at the fixing nip N1, moisture contained in the sheet P is vaporized into steam. While the sheet P is conveyed through the fixing nip N1, since the sheet P receives substantial surface pressure of about 40 [N/cm$^2$], steam is not discharged from the sheet P. Conversely, when the sheet P is ejected from the fixing nip N1, since the sheet P receives no pressure, steam is discharged from the sheet P.

As illustrated in FIG. 3, a decreased gap between the pressure roller 45 and the fixing belt 43 stretched by the separation aid 48C at a position in proximity to the exit N1*e* of the fixing nip N1 is smaller than an increased gap between the pressure roller 45 and the fixing belt 43 configured to be wound around the fixing roller 41. Since heat is stored in the decreased gap between the pressure roller 45 and the fixing belt 43 stretched by the separation aid 48C, the temperature of the sheet P does not decrease and substantial steam is discharged from the sheet P. Steam is mainly discharged from a back side of the sheet P that is disposed opposite the pressure roller 45. The sheet P ejected from the fixing nip N1, while the sheet P is adhered to the fixing belt 43, is conveyed to the separation position of the fixing belt 43 that is disposed opposite the front edge of the separation plate 46C. A height of a non-image section on the sheet P that does not bear the toner image T is smaller than a height of an image section on the sheet P that bears the toner image T. Accordingly, a gap is produced between the fixing belt 43 and the non-image section on the sheet P. Steam is discharged from the sheet P to the gap. As the sheet P discharges steam, fiber of the sheet P dries. Accordingly, the sheet P shrinks and waves.

Steam mainly discharged from the back side of the sheet P that is disposed opposite the pressure roller 45 remains in the decreased gap between the pressure roller 45 and the fixing belt 43 stretched by the separation aid 48C. Steam is reabsorbed by the sheet P and moistens the sheet P. Steam discharged to the gap between the fixing belt 43 and the non-image section on the sheet P remains in the decreased gap. Steam is reabsorbed by the sheet P and moistens the sheet P. As the sheet P is moistened, fiber of the sheet P stretches. Accordingly, the sheet P waves.

Figure 4:
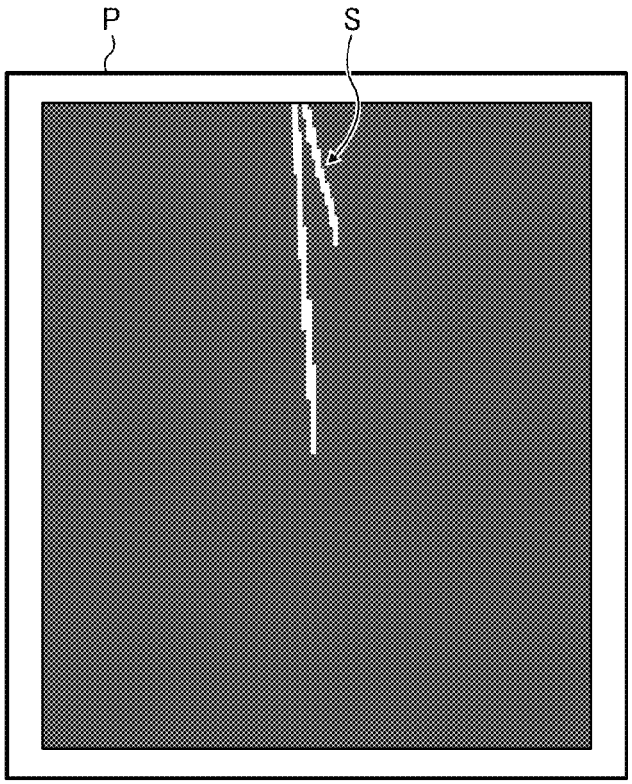
FIG. 4 is a plan view of a sheet having creases produced after the sheet passes through the comparative fixing device depicted in FIG. 3.

In the comparative fixing device 40C depicted in FIG. 3, while the sheet P is conveyed in the separation span of the fixing belt 43 that is defined from the nip position disposed opposite the fixing nip N1 to the separation position disposed opposite the front edge of the separation plate 46C, fiber of the sheet P suffers from contraction as the sheet P discharges steam and dries and expansion as the sheet P reabsorbs steam and moistens. Accordingly, the sheet P waves. As the waved sheet P is sandwiched by the output roller pair 52 or the like depicted in FIG. 1, the sheet P may suffer from creases S as illustrated in FIG. 4. FIG. 4 is a plan view of the sheet P having the creases S.

To address this circumstance, the fixing device 40 according to this exemplary embodiment depicted in FIG. 2 incorporates the presser 49 that is interposed between the fixing roller 41 and the separation aid 48 in the rotation direction D43 of the fixing belt 43 and in contact with the inner circumferential surface of the fixing belt 43. The presser 49 presses the fixing belt 43 against the pressure roller 45.

A detailed description is now given of a construction of the presser 49.

Figure 5:
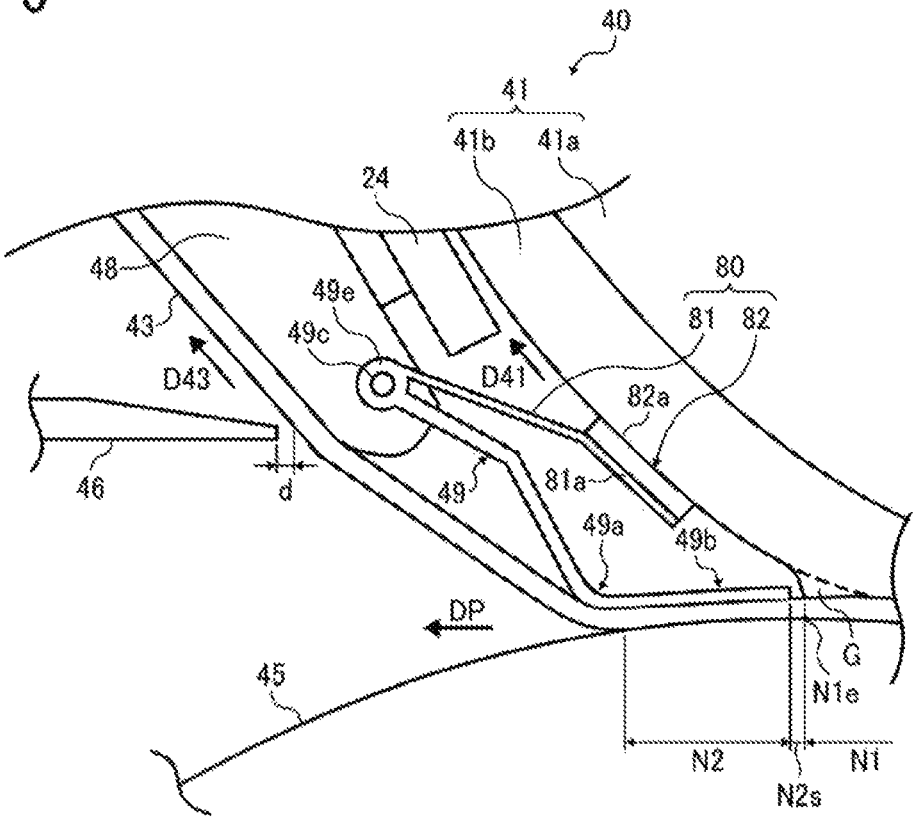
FIG. 5 is a partially enlarged, vertical cross-sectional view of the fixing device depicted in FIG. 2, illustrating a gap retainer incorporated therein.

FIG. 5 is a partially enlarged, vertical cross-sectional view of the fixing device 40, illustrating components situated in proximity to the exit N1*e* of the fixing nip N1. The presser 49 is disposed inside the loop formed by the fixing belt 43 and interposed between the fixing nip N1 and the separation aid 48 in the rotation direction D43 of the fixing belt 43. The presser 49 is a plate made of metal such as SUS stainless steel and has a thickness of about 0.2 mm. One end of the presser 49 is rotatably supported by the separation aid 48. The presser 49 extends from the separation aid 48 toward the pressure roller 45. The presser 49 is bent toward the fixing nip N1 at an intermediate portion of the presser 49, thus defining a flat spring shape. Since the presser 49 is bent at the intermediate portion thereof, the presser 49 contacts the inner circumferential surface of the fixing belt 43. Hence, the presser 49 includes a pressing portion 49*b* and a peel-off portion 49*a*. The pressing portion 49*b* presses the fixing belt 43 against the pressure roller 45. The peel-off portion 49*a* is curved and disposed downstream from the pressing portion 49*b* in the rotation direction D43 of the fixing belt 43.

The presser 49 engages the pressure roller 45 by 0.4 mm. The presser 49 is resiliently deformed to press the fixing belt 43 against the pressure roller 45 with a predetermined load. Accordingly, the presser 49 forms a post nip N2 that is disposed downstream from the fixing nip N1 in the sheet conveyance direction DP.

The pressing portion 49*b* of the presser 49 has a shape corresponding to an outer circumferential surface of the pressure roller 45 to press the fixing belt 43 against the pressure roller 45 evenly. At an exit of the post nip N2, the rotation direction D43 of the fixing belt 43 changes sharply along a curve of the peel-off portion 49*a* of the presser 49. Accordingly, the curvature of the fixing belt 43 increases at the exit of the post nip N2. In other words, the radius of curvature of the fixing belt 43 decreases at the exit of the post nip N2. According to this exemplary embodiment, the peel-off portion 49*a* of the presser 49 is curved such that the radius of curvature of the fixing belt 43 is 6 mm at the exit of the post nip N2.

The sheet P ejected from the fixing nip N1 is conveyed while the sheet P receives pressure from the pressure roller 45 at the post nip N2 continuously after the sheet P receives pressure at the fixing nip N1. Since pressure exerted to the sheet P at the post nip N2 is smaller than pressure exerted to the sheet P at the fixing nip N1, the sheet P discharges steam at the post nip N2. As the sheet P discharges steam, the sheet P is susceptible to drying of fiber and shrinking. However, since the presser 49 presses the sheet P against the pressure roller 45 via the fixing belt 43, fiber of the sheet P does not shrink and therefore the sheet P is immune from waving caused by discharging of steam.

Steam discharged at the post nip N2 remains between the sheet P and the fixing belt 43 and the like as air bubbles and is reabsorbed by the sheet P, moistening the sheet P. However, while the sheet P absorbs steam, the presser 49 presses the sheet P against the pressure roller 45 via the fixing belt 43. Accordingly, even if fiber of the sheet P that absorbs steam and moistens is susceptible to stretch, since the presser 49 presses the sheet P against the pressure roller 45 via the fixing belt 43, fiber of the sheet P does not stretch and therefore the sheet P is immune from waving caused by absorption of steam.

Since the sheet P is immune from waving, even when the sheet P ejected from the fixing nip N1 is sandwiched and conveyed by the output roller pair 52 depicted in FIG. 1, the sheet P is immune from the streaked creases S illustrated in FIG. 4.

According to this exemplary embodiment, the presser 49 presses the sheet P against the pressure roller 45 via the fixing belt 43 to prevent fiber of the sheet P from contracting and expanding as the sheet P discharges and absorbs steam. Pressure with which the presser 49 presses the sheet P against the pressure roller 45 via the fixing belt 43 is sufficiently smaller than pressure with which the pressure roller 45 presses the sheet P against the fixing roller 41 via the fixing belt 43 at the fixing nip N1. According to this exemplary embodiment, pressure exerted to the sheet P at the post nip N2 is about 5 [N]. The presser 49 suppresses waving of the sheet P with pressure great enough to prevent the streaked creases S on the sheet P illustrated in FIG. 4. Hence, the presser 49 may press the fixing belt 43 toward the pressure roller 45 such that the fixing belt 43 is in contact with or in proximity to the pressure roller 45 with a slight interval between the fixing belt 43 and the pressure roller 45. In this case, when the sheet P is ejected from the fixing nip N1 and is susceptible to waving as the sheet P discharges and absorbs steam, the sheet P comes into contact with the pressure roller or the fixing belt 43 which prevents the sheet P from waving further. Hence, even if the presser 49 presses the fixing belt 43 toward the pressure roller 45 such that the fixing belt 43 is in contact with or in proximity to the pressure roller 45 with the slight interval between the fixing belt 43 and the pressure roller 45, the presser 49 suppresses waving of the sheet P.

In a configuration in which the presser 49 presses the fixing belt 43 toward the pressure roller 45 such that the fixing belt 43 does not contact the pressure roller 45, if the slight interval between the fixing belt 43 and the pressure roller 45 is equivalent to a thickness of the sheet P, the sheet P ejected from the fixing nip N1 is conveyed while the sheet P is sandwiched between the fixing belt 43 and the pressure roller 45. Thus, the presser 49 suppresses waving of the sheet P more effectively.

At the exit of the post nip N2, the rotation direction D43 of the fixing belt 43 changes sharply along the curve of the peel-off portion 49*a* of the presser 49. Accordingly, the sheet P is separated from the fixing belt 43 by the curvature of the fixing belt 43 at the exit of the post nip N2. A soft sheet P such as thin paper or a sheet P bearing a toner image T extending to a leading end of the sheet P is not separated from the fixing belt 43 by the curvature of the fixing belt 43 at the exit of the post nip N2 and is conveyed to a separation position of the fixing belt 43 that is disposed opposite a front edge of the separation plate 46 while the sheet P adheres to the fixing belt 43. However, steam generated by the sheet P while the sheet P is conveyed through the fixing nip N1 is already discharged from the sheet P while the sheet P is conveyed through the post nip N2. Accordingly, steam is barely discharged from the sheet P while the sheet P moves to the separation position of the fixing belt 43 that is disposed opposite the front edge of the separation plate 46.

Additionally, an increased gap between the fixing belt 43 and the pressure roller 45 at a position in proximity to the exit of the post nip N2 is greater than the decreased gap between the pressure roller 45 and the fixing belt 43 depicted in FIG. 3. Accordingly, heat is not stored at the position in proximity to the exit of the post nip N2 and is dissipated to surroundings. Hence, while the sheet P moves to the separation position of the fixing belt 43 that is disposed opposite the front edge of the separation plate 46, the sheet P is barely heated by heat stored at the position in proximity to the exit of the post nip N2 and therefore barely discharges steam. Consequently, while the sheet P moves from the post nip N2 to the separation position of the fixing belt 43 that is disposed opposite the front edge of the separation plate 46, the sheet P barely discharges steam and dries and therefore barely waves.

Steam not reabsorbed by the sheet P at the post nip N2 is discharged to the surroundings at the exit of the post nip N2. However, since the increased gap between the fixing belt 43 and the pressure roller 45 at the position in proximity to the exit of the post nip N2 is greater than the decreased gap between the pressure roller 45 and the fixing belt 43 depicted in FIG. 3, steam does not accumulate at the position in proximity to the exit of the post nip N2. Accordingly, while the sheet P moves from the post nip N2 to the separation position of the fixing belt 43 that is disposed opposite the front edge of the separation plate 46, the sheet P barely reabsorbs steam. Consequently, while the sheet P moves from the post nip N2 to the separation position of the fixing belt 43 that is disposed opposite the front edge of the separation plate 46, the sheet P barely reabsorbs steam and moistens and therefore barely waves.

Since the presser 49 presses the fixing belt 43 against the pressure roller 45, the fixing belt 43 is hung freely without contacting any component in a free span defined from the exit of the post nip N2 to the separation aid 48 in the rotation direction D43 of the fixing belt 43. The free span of the fixing belt 43 of the fixing device 40 depicted in FIG. 5 is smaller than a free span of the fixing belt 43 that is defined from the exit N1*e* of the fixing nip N1 to the separation aid 48C of the comparative fixing device 40C in the rotation direction D43 of the fixing belt 43 depicted in FIG. 3.

A thermal capacity of the presser 49 made of a plate is smaller than a thermal capacity of the presser 49 made of a block, suppressing conduction of heat from the fixing belt 43 to the presser 49 formed in the plate. Accordingly, compared to the presser 49 made of the block, the presser 49 made of the plate shortens a waiting time for the user to wait until the fixing belt 43 is heated to the target temperature. Additionally, compared to the presser 49 made of the block, the presser 49 made of the plate suppresses power consumption, saving energy.

Since the presser 49 is made of a resilient material, the presser 49 deforms along the outer circumferential surface of the pressure roller 45 readily compared to the presser 49 made of a rigid body. Thus, the presser 49 presses the fixing belt 43 against the pressure roller 45 evenly with a predetermined load.

According to this exemplary embodiment, the sheet P separates from the fixing belt 43 at three separation positions thereon. The three separation positions include a first separation position where the fixing belt 43 is curved at the exit of the post nip N2 formed between the peel-off portion 49*a* of the presser 49 and the pressure roller 45; a second separation position where the fixing belt 43 is curved by the separation aid 48; and a third separation position where the fixing belt 43 is disposed opposite the front edge of the separation plate 46. Accordingly, the fixing belt 43 attaining the three separation positions separates the sheet P from the fixing belt 43 precisely, preventing the sheet P from being jammed between the fixing belt 43 and the pressure roller 45 effectively.

A description is provided of a variation of the presser 49.

The presser 49 may have a shape other than the shape of the presser 49 depicted in FIG. 5. For example, the pressing portion 49*b* of the presser 49 is provided with an opening (e.g., a slot and a slit) to decrease the thermal capacity of the presser 49 and therefore shorten the waiting time for the user until the fixing belt 43 is heated to the target temperature, saving energy.

As illustrated in FIG. 5, a front edge of the pressing portion 49*b* of the presser 49 is disposed in proximity to the fixing roller 41. A border N2*s* is interposed between the fixing nip N1 and the post nip N2 in the sheet conveyance direction DP. At the post nip N2, the pressing portion 49*b* of the presser 49 presses the fixing belt 43 against the pressure roller 45. Conversely, at the border N2*s*, no component disposed inside the loop formed by the fixing belt 43 presses the fixing belt 43 against the pressure roller 45. Pressure with which the fixing belt 43 presses against the pressure roller 45 at the border N2*s* is smaller than pressure with which the fixing belt 43 presses against the pressure roller 45 at the post nip N2. If pressure exerted at the border N2*s* disposed upstream from the post nip N2 in the sheet conveyance direction DP is smaller than pressure exerted at the post nip N2, disadvantages may generate as described below. Since pressure exerted to the sheet P at the border N2*s* is smaller than pressure exerted to the sheet P at the fixing nip N1, the sheet P discharges steam at the border N2*s*. Accordingly, air bubbles generate between the sheet P and the fixing belt 43 and the like.

Additionally, as toner of the toner image T thermally expands, air contained in the toner of the toner image T leaks from the toner, generating air bubbles between the sheet P and the fixing belt 43. As the sheet P enters the post nip N2 exerted with pressure greater than pressure exerted to the border N2*s*, the air bubbles are pushed and moved by the presser 49 pressing against the pressure roller 45 via the fixing belt 43. Thus, the air bubbles move over the surface of the sheet P. Since the toner of the toner image T on the sheet P immediately after passing through the fixing nip N1 is not solidified completely, as the air bubbles move over the surface of the sheet P, the air bubbles may damage the toner image T, resulting in formation of a faulty toner image T having variation in gloss or the like.

To address this circumstance, the presser 49 presses the fixing belt 43 against the pressure roller 45 in an elongated span extending to a position in proximity to the fixing nip N1 to decrease the border N2*s*. The decreased border N2*s* suppresses generation of the air bubbles. For example, according to this exemplary embodiment, the presser 49 includes a fixed end mounted on the separation aid 48 and extending toward the pressure roller 45; the intermediate portion bent toward the fixing nip N1; and a free end serving as an upstream end of the presser 49 in the rotation direction D43 of the fixing belt 43. Compared to a configuration in which the presser 49 is bent and directed in the sheet conveyance direction DP, not directed to the fixing nip N1, such that a downstream end of the presser 49 in the rotation direction D43 of the fixing belt 43 is a free end, the presser 49 depicted in FIG. 5 is disposed in proximity to the fixing nip N1, decreasing the border N2*s*.

Similarly, in order to address the disadvantages described above, pressure exerted from the presser 49 to the fixing belt 43 is even or decreases in the sheet conveyance direction DP to cause pressure exerted from a downstream portion of the presser 49 in the sheet conveyance direction DP to be not greater than pressure exerted from an upstream portion of the presser 49 in the sheet conveyance direction DP. Accordingly, air bubbles produced by steam discharged from the sheet P are not pushed to the post nip N2 and do not move over the surface of the sheet P. Consequently, the presser 49 suppresses formation of a faulty toner image T having variation in gloss or the like at the post nip N2.

Table 2 below illustrates a result of an evaluation test of a length of the border N2*s* in the sheet conveyance direction DP.

TABLE 2

| Border N2s (mm) | Surface pressure exerted at border N2s (N/cm$^2$) | Prevention of variation in gloss of toner image |
|---|---|---|
| 5 | 3 | Very poor |
| 3 | 4 | Poor |
| 2.8 | 5 | Good (no variation in gloss) |
| 2.3 | 7 | Good (no variation in gloss) |
| 0 | 8 | Good (no variation in gloss) |

The evaluation test was performed with a solid toner image formed on an A3 size sheet under surface pressure of 40 [N/cm$^2$] exerted at the fixing nip N1 and surface pressure of 2.84 [N/cm$^2$] (0.29 [kg/cm$^2$]) exerted at the post nip N2. The solid toner image was visually checked to evaluate variation in gloss. Each of the surface pressures was measured with I-SCAN. In the "Prevention of variation in gloss of toner image" column of Table 2, good indicates that variation in gloss was not identified and evaluation is leveled as good. Very poor and poor indicate that variation in gloss was identified and evaluation is leveled as very poor and poor. The surface pressure exerted at the border N2*s* indicates an average pressure of pressures exerted in a span from the exit N1*e* of the fixing nip N1 to the upstream end of the presser 49 in the rotation direction D43 of the fixing belt 43. The surface pressure exerted at the post nip N2 indicates an average pressure of pressures exerted in a span from the upstream end to the downstream end of the presser 49 in the rotation direction D43 of the fixing belt 43. The surface pressure exerted at the post nip N2 slightly decreases from an upstream end to a downstream end of the post nip N2 in the rotation direction D43 of the fixing belt 43. The surface pressure exerted at the upstream end of the post nip N2 in the rotation direction D43 of the fixing belt 43 is about 8 [N/cm$^2$].

As illustrated in Table 2, if the length of the border N2*s* in the rotation direction D43 of the fixing belt 43 is not greater than 2.8 mm, generation of air bubbles is suppressed at the border N2*s*, preventing air bubbles from being pushed out to the post nip N2 and moving over the surface of the sheet P. As a result, no variation in gloss appears on the solid toner image, attaining evaluation leveled as good.

A detailed description is now given of a configuration of the fixing roller 41.

The fixing roller 41 is requested to rotate at high speed to improve productivity of the fixing device 40. If the presser 49 contacts the fixing roller 41 while the fixing roller 41 rotates at high speed, the presser 49 may degrade rotation of the fixing roller 41, increasing a load torque imposed on the fixing roller 41. Additionally, the presser 49 may shave the outer circumferential surface of the fixing roller 41, degrading durability of the fixing roller 41 and resulting in breakage of the fixing roller 41. To address this circumstance, the presser 49 is requested to be isolated from the fixing roller 41. On the other hand, the presser 49 is requested to be in proximity to the fixing nip N1 to suppress variation in gloss of the toner image T as described above.

If the fixing roller 41 is a hard roller having a hardness greater than a hardness of the pressure roller 45 to allow the pressure roller 45 to deform as the pressure roller 45 is pressed against the fixing roller 41 via the fixing belt 43, a gap provided between the fixing roller 41 and the inner circumferential surface of the fixing belt 43 and situated downstream from the exit N1*e* of the fixing nip N1 in the sheet conveyance direction DP increases gradually from the exit N1*e* of the fixing nip N1 so that the gap has a wedge shape. Accordingly, the gap provided between the fixing roller 41 and the inner circumferential surface of the fixing belt 43 and situated in proximity to the exit N1*e* of the fixing nip N1 is smaller than a thickness of the platy presser 49.

If the presser 49 comes into contact with the outer circumferential surface of the fixing roller 41, a front edge of the presser 49 may damage the outer circumferential surface of the fixing roller 41. To address this circumstance, the presser 49 is requested to be isolated from the fixing roller 41. However, the presser 49 is not placed in the wedge-shaped gap provided between the fixing roller 41 and the inner circumferential surface of the fixing belt 43 and is not situated in proximity to the exit N1*e* of the fixing nip N1 because the gap is smaller than the thickness of the platy presser 49. Further, in order to prevent the presser 49 from contacting the fixing roller 41 due to tolerance of parts and assembly errors, the free end of the presser 49 is spaced apart from the exit N1*e* of the fixing nip N1. To address this circumstance, the fixing roller 41 is constructed of a core bar and an elastic layer. A hardness of the fixing roller 41 is smaller than a hardness of the pressure roller 45 so that the elastic layer of the fixing roller 41 is deformed by pressure from the pressure roller 45.

As illustrated in FIG. 5, the fixing roller 41 is constructed of a core bar 41*a* and an elastic layer 41*b* coating the core bar 41*a*. Hence, the hardness of the fixing roller 41 is smaller than the hardness of the pressure roller 45 so that the elastic layer 41*b* of the fixing roller 41 is deformed by pressure from the pressure roller 45. The elastic layer 41*b* is mounted on the core bar 41*a* and made of silicone rubber having a thickness of about 20 mm. The fixing roller 41 has an Asker C hardness of 42 plus and minus 3 Hs that is smaller than an Asker C hardness of 68 plus and minus 3 Hs of the pressure roller 45.

As the pressure roller 45 is pressed against the fixing roller 41 via the fixing belt 43, the elastic layer 41*b* of the fixing roller 41 is deformed and fills in a wedge-shaped gap G indicated by a dotted line in FIG. 5 and provided between the fixing roller 41 and the fixing belt 43. At the exit N1*e* of the fixing nip N1, the outer circumferential surface of the fixing roller 41 is contoured to bulge sharply from the inner circumferential surface of the fixing belt 43. Accordingly, as illustrated in FIG. 5, the free end of the presser 49 is disposed in proximity to the fixing nip N1 such that the presser 49 is isolated from the outer circumferential surface of the fixing roller 41, thus decreasing the border N2*s*. Consequently, at the border N2*s*, the amount of steam discharged from the sheet P and the amount of thermal expansion of air contained in toner of the toner image T on the sheet P decrease, suppressing generation of air bubbles precisely and suppressing variation in gloss of the toner image T on the sheet P further.

In order to elastically deform the elastic layer 41*b* of the fixing roller 41 precisely, the hardness of the fixing roller 41 is not greater than the hardness of the pressure roller 45. If the hardness of the pressure roller 45 is smaller than the hardness of the fixing roller 41, the pressure roller 45 may deform elastically and may barely exert pressure to the fixing roller 41 that is great enough to deform the elastic layer 41*b* of the fixing roller 41. Accordingly, the outer circumferential surface of the fixing roller 41 at the exit N1*e* of the fixing nip N1 is contoured to separate gradually from the fixing belt 43. The gap between the fixing belt 43 and the fixing roller 41 at the position in proximity to the exit N1*e* of the fixing nip N1 is enlarged gradually from the exit N1*e* of the fixing nip N1 to define the wedge-shaped gap G. Hence, the presser 49 may not be situated in proximity to the fixing nip N1.

According to this exemplary embodiment, the Asker C hardness of 42 plus and minus 3 Hs of the fixing roller 41 is smaller than the Asker C hardness of 68 plus and minus 3 Hs of the pressure roller 45 by about 20 Hs. Since the hardness of the fixing roller 41 is smaller than the hardness of the pressure roller 45, the pressure roller 45 deforms the elastic layer 41*b* of the fixing roller 41 precisely. Accordingly, at the exit N1*e* of the fixing nip N1, the outer circumferential surface of the fixing roller 41 is contoured to bulge sharply from the inner circumferential surface of the fixing belt 43. Thus, the presser 49 is situated in proximity to the fixing nip N1.

In order to allow the deformed elastic layer 41*b* to contour the outer circumferential surface of the fixing roller 41 at the exit N1*e* of the fixing nip N1 to bulge sharply from the inner circumferential surface of the fixing belt 43, the thickness of the elastic layer 41*b* is greater than a predetermined thickness. Since the elastic layer 41*b* is made of rubber as described above, the elastic layer 41*b* has an increased thermal expansion rate. Accordingly, as the thickness of the elastic layer 41*b* increases, thermal expansion of the fixing roller 41 increases. Thus, the outer circumferential surface of the fixing roller 41 may come into contact with the presser 49.

If the fixing roller 41 expands thermally, a gap between the fixing roller 41 and the presser 49 in the sheet conveyance direction DP may decrease and the fixing roller 41 may come into contact with the presser 49. If the presser 49 contacts the outer circumferential surface of the fixing roller 41, the presser 49 may damage the outer circumferential surface of the fixing roller 41.

Even in a configuration in which the presser 49 is disposed downstream from the fixing roller 41 in the sheet conveyance direction DP, such that the front edge of the presser 49 is in proximity to the fixing roller 41, to prevent the sheet P ejected from the fixing nip N1 from waving as the sheet P discharges steam, dries, reabsorbs steam, and moistens, the presser 49 may damage the outer circumferential surface of the fixing roller 41.

Additionally, if an amount of deformation of the elastic layer 41*b* of the fixing roller 41 caused by pressure from the pressure roller 45 changes, the gap between the presser 49 and the outer circumferential surface of the fixing roller 41 may decrease and the presser 49 may come into contact with the outer circumferential surface of the fixing roller 41.

To address those circumstances, the fixing device 40 according to this exemplary embodiment includes a gap retainer 80 that retains the gap between the presser 49 and the outer circumferential surface of the fixing roller 41 to prevent the outer circumferential surface of the fixing roller 41 from coming into contact with the presser 49.

A description is provided of a construction of the gap retainer 80.

As illustrated in FIG. 5, the gap retainer 80 includes an arm 81 and an abutment 82. The arm 81 is combined or molded with the presser 49. The abutment 82 contacts the outer circumferential surface of the fixing roller 41. The presser 49 is pivotally attached to a shaft 49*c* mounted on each lateral end of the separation aid 48 in a longitudinal direction thereof parallel to the axial direction of the fixing roller 41. The presser 49 includes a bearing 49*e* attached to the shaft 49*c*. The arm 81 extends from the bearing 49*e* and includes a mount 81*a* being disposed at a front end of the arm 81 and mounting the abutment 82. The abutment 82 is secured to the mount 81*a* with an adhesive or the like.

The abutment 82 is rectangular. At least a contact face 82*a* of the abutment 82 that contacts the fixing roller 41 is coated with self-lubricating resin (e.g., fluoro resin). Thus, the abutment 82 decreases a coefficient of friction between the abutment 82 and the fixing roller 41, suppressing abrasion of the fixing roller 41. The contact face 82*a* of the abutment 82 that contacts the outer circumferential surface of the fixing roller 41 has a plane or a curve curved along the outer circumferential surface of the fixing roller 41. Accordingly, the abutment 82 corresponds to or follows movement or change of the outer circumferential surface of the fixing roller 41 in a normal direction thereto precisely. An experiment reveals that if a length of the contact face 82*a* in the rotation direction D41 of the fixing roller 41 is not smaller than 10 mm, the abutment 82 corresponds to change of the outer circumferential surface of the fixing roller 41 in the normal direction thereto precisely.

Figure 6:
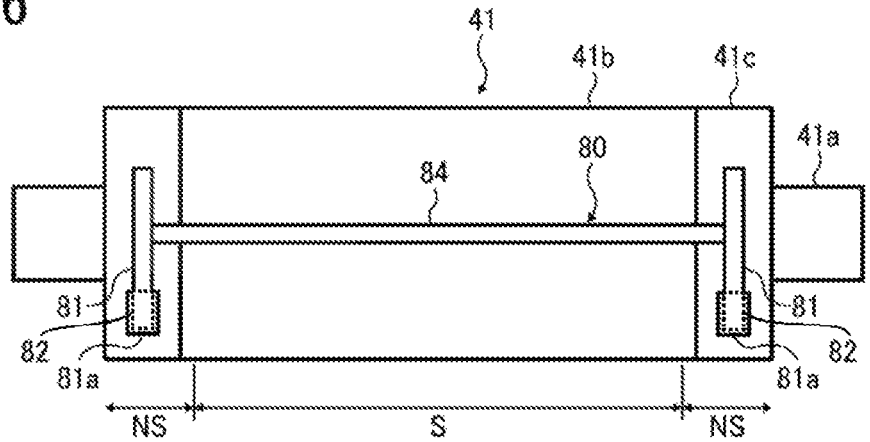
FIG. 6 is a schematic side view of a fixing roller and the gap retainer incorporated in the fixing device depicted in FIG. 5.

FIG. 6 is a schematic side view of the fixing roller 41 and the gap retainer 80, illustrating a downstream side thereof in the sheet conveyance direction DP. As illustrated in FIG. 6, the arm 81 is disposed at each lateral end of the gap retainer 80 in the axial direction of the fixing roller 41. As illustrated in FIGS. 5 and 6, the abutment 82 is mounted on the mount 81*a* of each arm 81. A coupler 84 couples the arm 81 disposed opposite one lateral end of the fixing roller 41 in the axial direction thereof to the arm 81 disposed opposite another lateral end of the fixing roller 41 in the axial direction thereof.

Since the abutment 82 contacts the outer circumferential surface of the fixing roller 41, a contact portion of the fixing roller 41 that contacts the abutment 82 may suffer from abrasion and therefore may be recessed from other portion of the fixing roller 41. If the abutment 82 contacts the fixing roller 41 in a conveyance span S depicted in FIG. 6 where the sheet P is conveyed over the fixing belt 43, the contact portion of the fixing roller 41 that contacts the abutment 82 in the conveyance span S may be recessed by abrasion, decreasing pressure exerted to the sheet P at the fixing nip N1 in the conveyance span S and resulting in faulty fixing or the like. To address this circumstance, according to this exemplary embodiment, each of the abutments 82 contacts the outer circumferential surface of the fixing roller 41 in a non-conveyance span NS that is disposed outboard from the conveyance span S in the axial direction of the fixing roller 41. Accordingly, even if the contact portion of the fixing roller 41 that contacts the abutment 82 is recessed from other portion of the fixing roller 41 due to abrasion, the recessed contact portion of the fixing roller 41 does not adversely affect fixing performance of the fixing device 40, suppressing faulty fixing. For example, the conveyance span S corresponds to a width of a maximum size sheet in the axial direction of the fixing belt 43, which is available in the fixing device 40.

Similar to the abutment 82, the outer circumferential surface of the fixing roller 41 is coated with a friction reducing material such as self-lubricating resin to decrease the coefficient of friction between the fixing roller 41 and the abutment 82. However, if the entire outer circumferential surface of the fixing roller 41 is coated with self-lubricating resin, a disadvantage may occur as described below. For example, the coefficient of friction between the fixing roller 41 and the fixing belt 43 may decrease, causing slippage of the fixing roller 41 over the fixing belt 43. To address this circumstance, according to this exemplary embodiment, a low-friction portion 41*c*, serving as the contact portion of the fixing roller 41 that contacts the abutment 82, coats the fixing roller 41 in a contact span, that is, the non-conveyance span NS, where the abutment 82 contacts the fixing roller 41. The low-friction portion 41*c* is made of self-lubricating resin. Thus, the low-friction portion 41*c* decreases the coefficient of friction between the abutment 82 and the fixing roller 41 in the non-conveyance span NS, suppressing slippage of the fixing roller 41 over the fixing belt 43 and abrasion of the non-conveyance span NS of the fixing roller 41 where the abutment 82 contacts the fixing roller 41.

Alternatively, the low-friction portion 41*c* may be a tube made of self-lubricating resin and wound around the contact portion of the fixing roller 41 that contacts the abutment 82. A length of the low-friction portion 41*c* in the axial direction of the fixing roller 41 is determined based on of the abutment 82 in the axial direction of the fixing roller 41 and an extra length determined by considering an amount of skew of the fixing roller 41 and tolerance of parts.

As the fixing roller 41 expands thermally, the fixing roller 41 presses the abutment 82 in the normal direction to the outer circumferential surface of the fixing roller 41. The presser 49, together with the arm 81, pivots about the shaft 49*c* clockwise in FIG. 5. The pressing portion 49*b* of the presser 49 moves in a separation direction in which the pressing portion 49*b* separates from the fixing roller 41, thus retaining the gap between the presser 49 and the outer circumferential surface of the fixing roller 41. Thus, even if the fixing roller 41 expands thermally, the fixing roller 41 does not come into contact with the presser 49 and therefore the presser 49 does not scratch the outer circumferential surface of the fixing roller 41 faultily.

Since the peel-off portion 49*a* of the presser 49 stretches the fixing belt 43, as the temperature of the fixing roller 41 decreases and thermal expansion of the fixing roller 41 decreases, a repulsive force of the fixing belt 43 pivots the presser 49 and the arm 81 combined with the presser 49 counterclockwise in FIG. 5. Accordingly, the pressing portion 49*b* of the presser 49 moves toward the fixing roller 41, suppressing variation in gloss of the toner image T on the sheet P precisely without enlarging the border N2*s*.

If the arm 81 has a decreased rigidity, as the fixing roller 41 expands thermally and presses the abutment 82 in the normal direction to the outer circumferential surface of the fixing roller 41, the arm 81 may be deformed resiliently and bent. Accordingly, the arm 81 may not pivot together with the presser 49 clockwise in FIG. 5. To address this circumstance, the arm 81 has a rigidity great enough to prevent resilient deformation when the fixing roller 41 expands thermally and presses the abutment 82 in the normal direction to the outer circumferential surface of the fixing roller 41. For example, a force that deforms the arm 81 resiliently is not smaller than a friction between the pressing portion 49*b* of the presser 49 and the inner circumferential surface of the fixing belt 43. Accordingly, even if the fixing roller 41 expands thermally and presses the abutment 82 in the normal direction to the outer circumferential surface of the fixing roller 41, the arm 81 does not deform resiliently and pivots together with the presser 49.

As the thickness of the arm 81 increases, the rigidity of the arm 81 increases. Thus, the force that deforms the arm 81 resiliently is not smaller than the friction between the pressing portion 49*b* of the presser 49 and the inner circumferential surface of the fixing belt 43. The thickness of the arm 81 is not smaller than 0.2 mm. Alternatively, the coupler 84 depicted in FIG. 6 may reinforce the arm 81 to increase the rigidity of the arm 81. The presser 49 may press the fixing belt 43 against the pressure roller 45 with decreased pressure. A contact face of the pressing portion 49*b* of the presser 49, which contacts the fixing belt 43, may be coated with self-lubricating resin to decrease friction between the pressing portion 49*b* of the presser 49 and the inner circumferential surface of the fixing belt 43.

The abutment 82 contacts the outer circumferential surface of the fixing roller 41 at a position in proximity to the fixing nip N1. Accordingly, even if an amount of deformation of the elastic layer 41*b* of the fixing roller 41 changes as pressure exerted by the pressure roller 45, that is, engagement of the pressure roller 45 with the elastic layer 41*b* of the fixing roller 41, changes and therefore the fixing roller 41 moves the abutment 82 in the normal direction to the outer circumferential surface of the fixing roller 41, the arm 81 corresponds to change in the amount of deformation of the elastic layer 41*b* of the fixing roller 41.

The abutment 82 and the arm 81 do not contact the fixing belt 43. If the abutment 82 and the arm 81 contact the fixing belt 43, the fixing belt 43 slides over the abutment 82 and the arm 81 frictionally in the rotation direction D43 of the fixing belt 43. Accordingly, friction between the fixing belt 43 and the arm 81 may pivot the arm 81 and the presser 49 together, enlarging the border N2*s*. To address this circumstance, the abutment 82 and the arm 81 are isolated from the fixing belt 43.

The arm 81 and the abutment 82 that are disposed opposite both lateral ends, that is, a first lateral end and a second lateral end, of the presser 49 in the axial direction of the fixing roller 41 achieve advantages below. If the arm 81 and the abutment 82 are disposed opposite the first lateral end of the presser 49, the second lateral end of the presser 49 that is not disposed opposite the arm 81 and the abutment 82 may not pivot similarly to the first lateral end of the presser 49 that is disposed opposite the arm 81 and the abutment 82. Accordingly, the second lateral end of the presser 49 may come into contact with the outer circumferential surface of the fixing roller 41. To address this circumstance, the arm 81 and the abutment 82 are disposed opposite the first lateral end and the second lateral end of the presser 49, allowing the presser 49 in the entire span in the axial direction of the fixing roller 41 to move in accordance with change of the outer circumferential surface of the fixing roller 41 in the normal direction thereto precisely and preventing the presser 49 from coming into contact with the outer circumferential surface of the fixing roller 41 precisely. The abutment 82 disposed opposite each lateral end of the fixing roller 41 in the axial direction thereof contacts the fixing roller 41, preventing a rotational torque of the fixing roller 41 from increasing and suppressing degradation in the life of the fixing roller 41.

The arm 81 disposed opposite the first lateral end of the presser 49 and the arm 81 disposed opposite the second lateral end of the presser 49 have an identical configuration so that the abutment 82 disposed opposite the first lateral end of the presser 49 contacts the fixing roller 41 at a first contact position and the abutment 82 disposed opposite the second lateral end of the presser 49 contacts the fixing roller 41 at a second contact position that overlaps the first contact position in an identical span in the rotation direction D43 of the fixing belt 43. If the first contact position does not overlap the second contact position, a first distance from a pivot axis of the arm 81 to the first contact position is different from a second distance from the pivot axis of the arm 81 to the second contact position. Accordingly, when the fixing roller 41 expands thermally, a pivot angle of the arm 81 disposed opposite the first lateral end of the presser 49 is different from a pivot angle of the arm 81 disposed opposite the second lateral end of the presser 49. Consequently, as the presser 49 pivots together with the arms 81, a pivot angle of the first lateral end of the presser 49 may be different from a pivot angle of the second lateral end of the presser 49, warping the presser 49.

A description is provided of a construction of a gap retainer 80S as a first variation of the gap retainer 80 depicted in FIG. 5.

Figure 7:
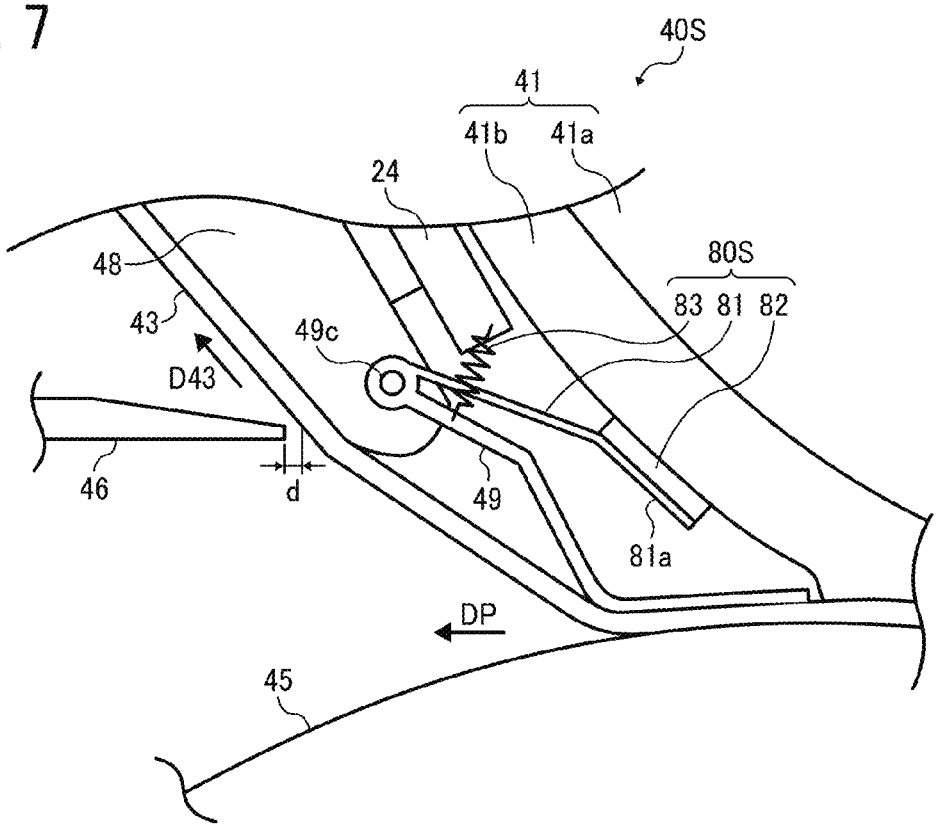
FIG. 7 is a schematic vertical cross-sectional view of a fixing device incorporating a gap retainer as a first variation of the gap retainer depicted in FIG. 5.

FIG. 7 is a schematic vertical cross-sectional view of a fixing device 40S incorporating the gap retainer 80S. As illustrated in FIG. 7, the gap retainer 80S includes a spring 83 that biases the presser 49 toward the fixing roller 41. One end of the spring 83 is anchored to a support 24 supporting the separation aid 48. Another end of the spring 83 is anchored to the presser 49. When the temperature of the fixing roller 41 decreases and thermal expansion of the fixing roller 41 decreases, a bias of the spring 83 pivots the presser 49 and the arm 81 combined with the presser 49 counterclockwise in FIG. 7. Accordingly, the presser 49 moves in accordance with change or movement of the outer circumferential surface of the fixing roller 41 in the normal direction thereto, thus preventing the border N2*s* from enlarging.

A description is provided of a construction of a gap retainer 80T as a second variation of the gap retainer 80 depicted in FIG. 5.

Figure 8:
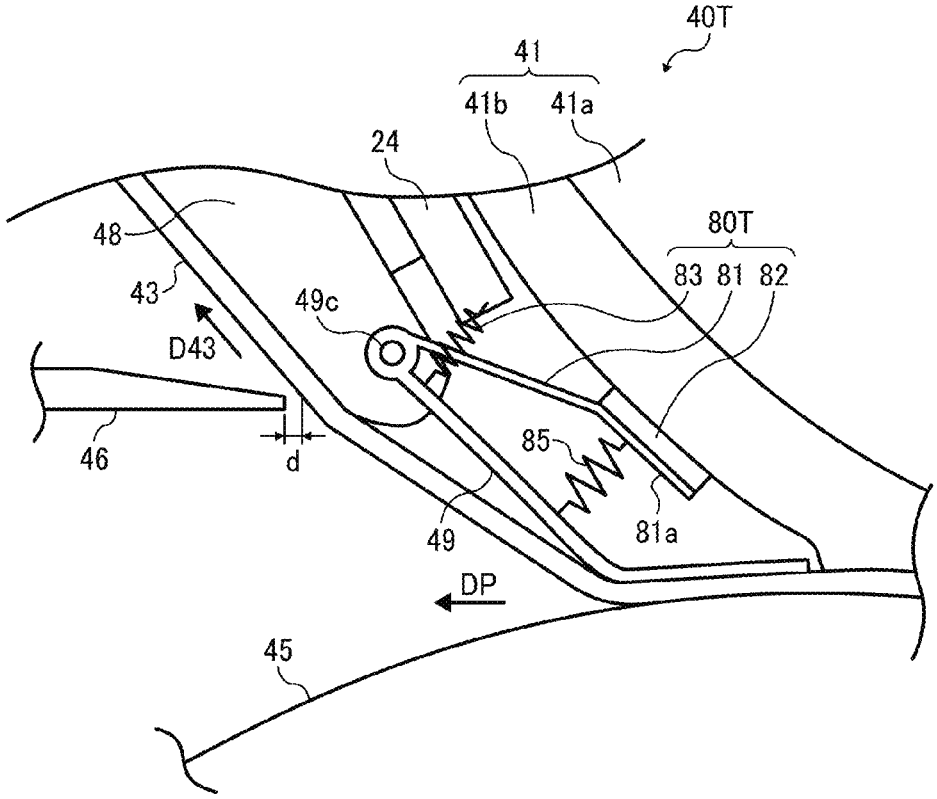
FIG. 8 is a schematic vertical cross-sectional view of a fixing device incorporating a gap retainer as a second variation of the gap retainer depicted in FIG. 5.
Figure 9:
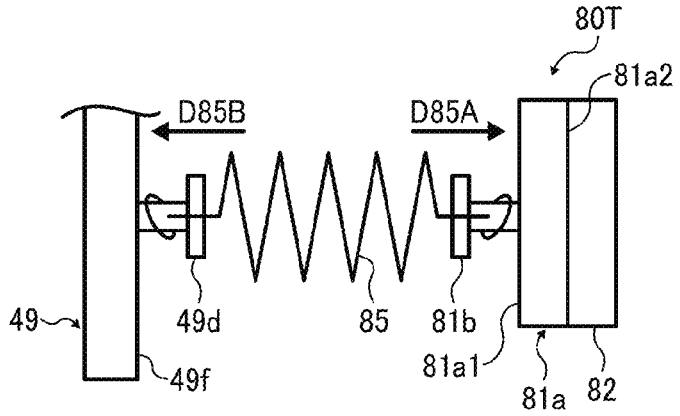
FIG. 9 is a partially enlarged cross-sectional view of the gap retainer depicted in FIG. 8.

FIG. 8 is a schematic vertical cross-sectional view of a fixing device 40T incorporating the gap retainer 80T. FIG. 9 is a partially enlarged cross-sectional view of the gap retainer 80T. As illustrated in FIG. 8, the gap retainer 80T includes a compression spring 85 interposed between the arm 81 and the presser 49. As illustrated in FIG. 9, one end of the compression spring 85 is anchored to a first spring bearing 81*b* mounted on a presser side face 81*a*1 of the mount 81*a* of the arm 81. The presser side face 81*a*1 is disposed opposite the presser 49 and is opposite a roller side face 81*a*2 mounting the abutment 82. Another end of the compression spring 85 is anchored to a second spring bearing 49*d* mounted on the presser 49. The compression spring 85 biases the arm 81 in a direction D85A in which the arm 81 separates from the presser 49. The compression spring 85 biases the presser 49 in a direction D85B in which the presser 49 separates from the arm 81.

As illustrated in FIG. 8, as the fixing roller 41 expands thermally, the fixing roller 41 presses the abutment 82 against the presser 49 via the compression spring 85. Accordingly, the arm 81 and the presser 49 pivot together precisely, allowing the presser 49 to move in accordance with change or movement of the outer circumferential surface of the fixing roller 41 in the normal direction thereto.

As illustrated in FIG. 9, the presser side face 81*a*1 of the mount 81*a* of the arm 81, that mounts the first spring bearing 81*b* to which one end of the compression spring 85 is anchored is parallel to a roller side face 49*f* of the presser 49, that mounts the second spring bearing 49*d* to which another end of the compression spring 85 is anchored. Accordingly, a bias of the compression spring 85 is exerted to the presser side face 81*a*1 and the roller side face 49*f* perpendicularly thereto. Consequently, as the fixing roller 41 expands thermally, the fixing roller 41 presses the abutment 82 against the presser 49 via the compression spring 85 precisely.

As the presser 49 deforms resiliently in accordance with the amount of engagement of the pressure roller 45 with the fixing roller 41 via the fixing belt 43, a distance from the presser 49 to the mount 81*a* of the arm 81 changes. However, even if the distance from the presser 49 to the mount 81*a* of the arm 81 changes, the compression spring 85 deforms resiliently to retain coupling between the presser 49 and the mount 81*a* of the arm 81 through the compression spring 85.

The bias of the compression spring 85 separates the presser 49 from the fixing roller 41. As the amount of engagement of the pressure roller 45 with the fixing roller 41 via the fixing belt 43 decreases, the bias of the compression spring 85 separates the presser 49 from the outer circumferential surface of the fixing roller 41. If the amount of engagement of the pressure roller 45 with the fixing roller 41 via the fixing belt 43 is configured to change according to the type of the sheet P, when the amount of engagement of the pressure roller 45 with the fixing roller 41 via the fixing belt 43 decreases, the border N2*s* may be greater than 2.8 mm.

A description is provided of a construction of a pressurization assembly 201 incorporated in the fixing device 40.

Figure 10:
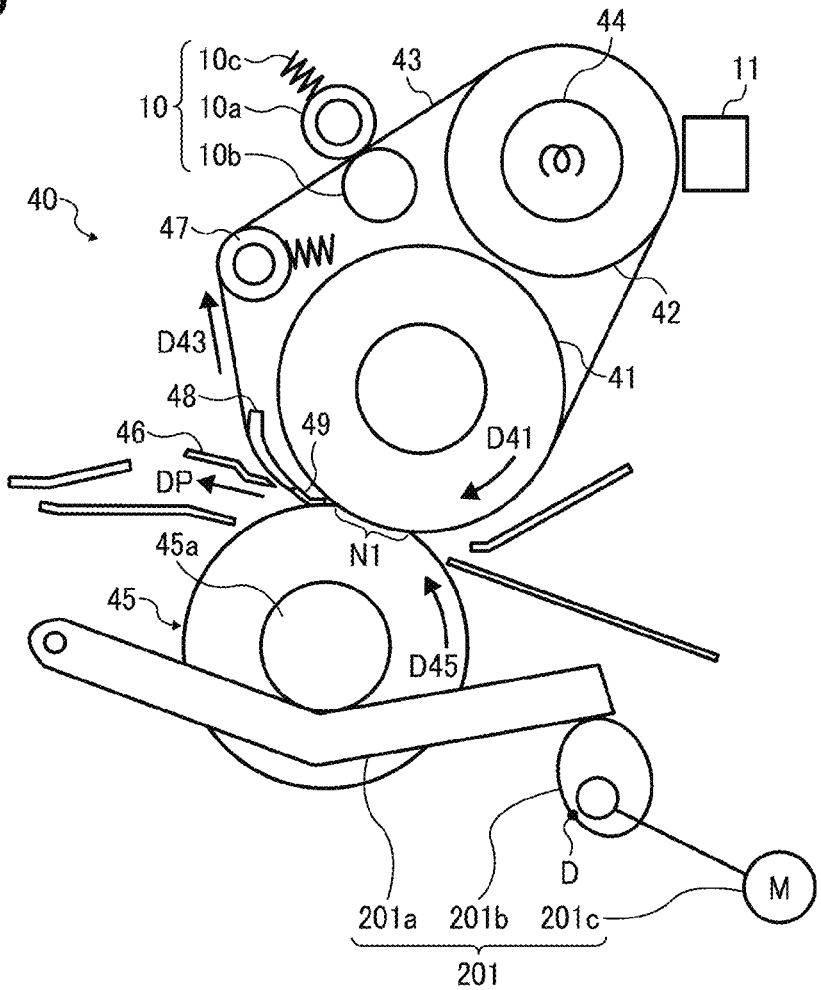
FIG. 10 is a schematic vertical cross-sectional view of the fixing device depicted in FIG. 2, illustrating a pressurization assembly incorporated therein.

FIG. 10 is a schematic vertical cross-sectional view of the fixing device 40, illustrating the pressurization assembly 201. As illustrated in FIG. 10, the pressurization assembly 201 includes a pressing arm 201*a*, a pressing cam 201*b*, and a driver 201*c* (e.g., a motor). The pressing arm 201*a* contacts a core bar 45*a* of the pressure roller 45. One end of the pressing arm 201*a* is rotatably supported. The pressing cam 201*b* contacts another end of the pressing arm 201*a*. As the driver 201*c* rotates the pressing cam 201*b*, the pressing cam 201*b* moves the pressing arm 201*a* in contact with the pressing cam 201*b*. The pressing arm 201*a* moves the pressure roller 45 to press the pressure roller 45 against the fixing roller 41 via the fixing belt 43 and release pressure exerted from the pressure roller 45 to the fixing roller 41.

When a depressurization position D of the pressing cam 201*b* contacts the pressing arm 201*a*, the pressing arm 201*a* positions the pressure roller 45 at a depressurization position where the pressure roller 45 releases pressure exerted to the fixing roller 41 via the fixing belt 43. The driver 201*c* rotates the pressing cam 201*b* to a proper position based on a rotation time elapsed after the depressurization position D of the pressing cam 201*b* contacts the pressing arm 201*a*, thus adjusting the amount of engagement of the pressure roller 45 with the fixing roller 41 via the fixing belt 43 according to a print mode of the fixing device 40. Table 3 below illustrates the depressurization position of the pressure roller 45 defined based on the rotation time elapsed after the depressurization position D of the pressing cam 201*b* contacts the pressing arm 201*a*. The rotation time illustrated in table 3 is one example. Alternatively, the rotation time may be defined based on the shape of the pressing cam 201*b*, the shape of the pressure roller 45, or the like.

TABLE 3

| Pressurization position of pressure roller | Rotation time of pressing cam (msec) | Print mode | Length of border N2s |
|---|---|---|---|
| Depressurization position | 0 | Standby mode While no sheet is conveyed through fixing device | No definition |
| Pressurization position 1 | 638 | Print on envelope | 2.8 mm or smaller |
| Pressurization position 2 | 1,700 | Print on thin paper | |
| Pressurization position 3 | 2,200 | Print on plain paper | |
| Pressurization position 4 | 2,802 | Print on thick paper | |

As illustrated in table 3, according to this exemplary embodiment, if the pressure roller 45 is not at the depressurization position when the depressurization position D of the pressing cam 201*b* contacts the pressing arm 201*a*, the pressurization position of the pressure roller 45 is adjusted properly to define the length of the border N2*s* of 2.8 mm or smaller.

A description is provided of a construction of a gap retainer 80U as a third variation of the gap retainer 80 depicted in FIG. 5.

Figure 11:
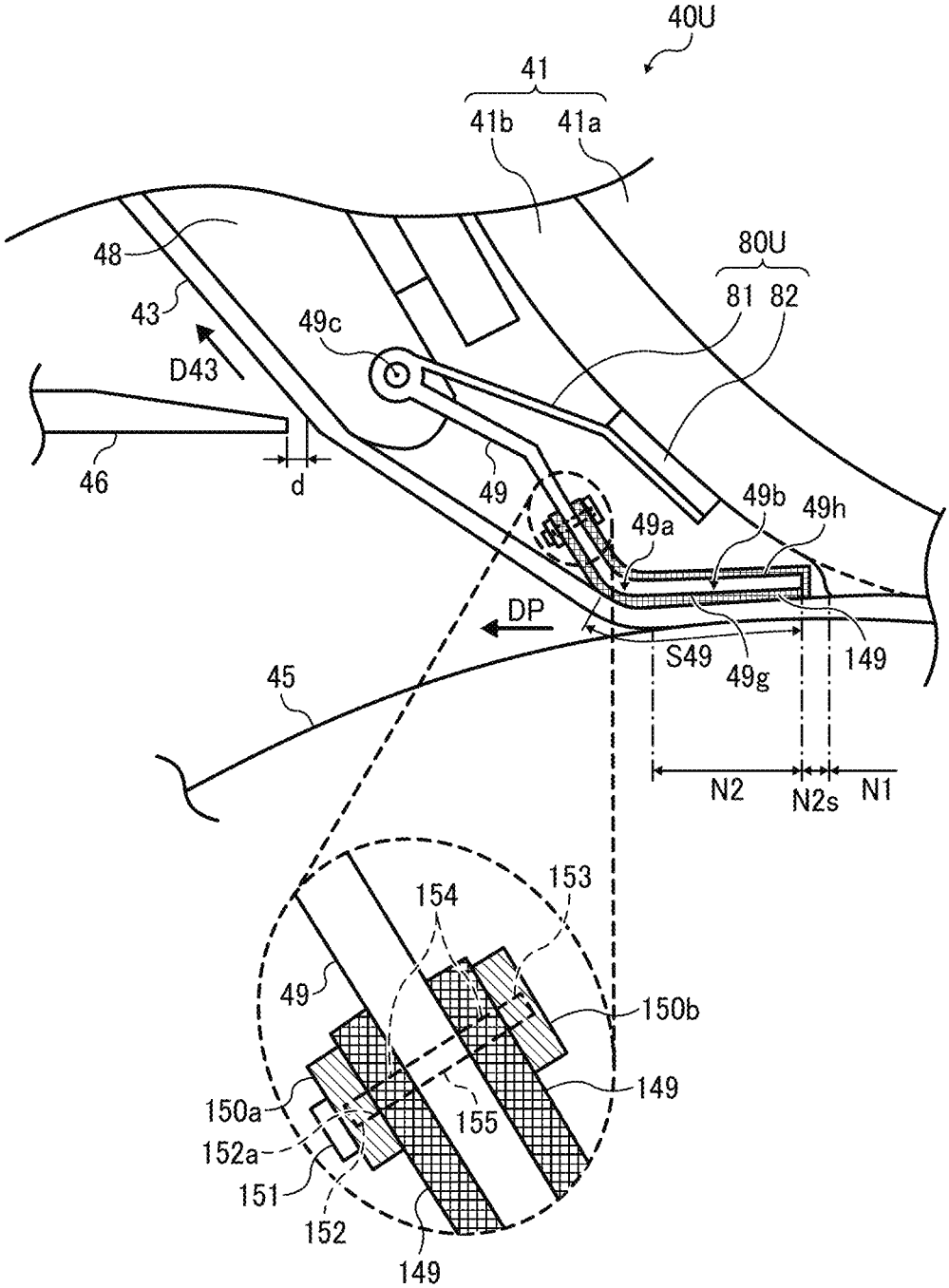
FIG. 11 is a schematic vertical cross-sectional view of a fixing device incorporating a gap retainer as a third variation of the gap retainer depicted in FIG. 5.
Figure 12:
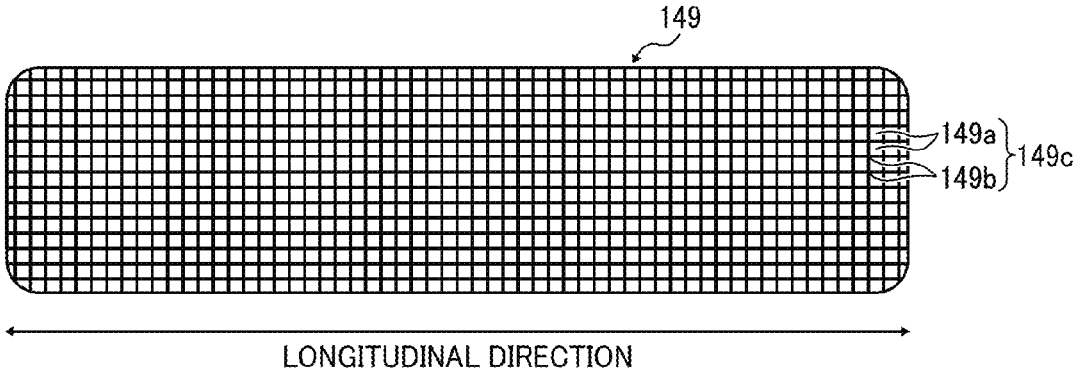
FIG. 12 is a plan view of a slide sheet incorporated in the fixing device depicted in FIG. 11.
Figure 13:
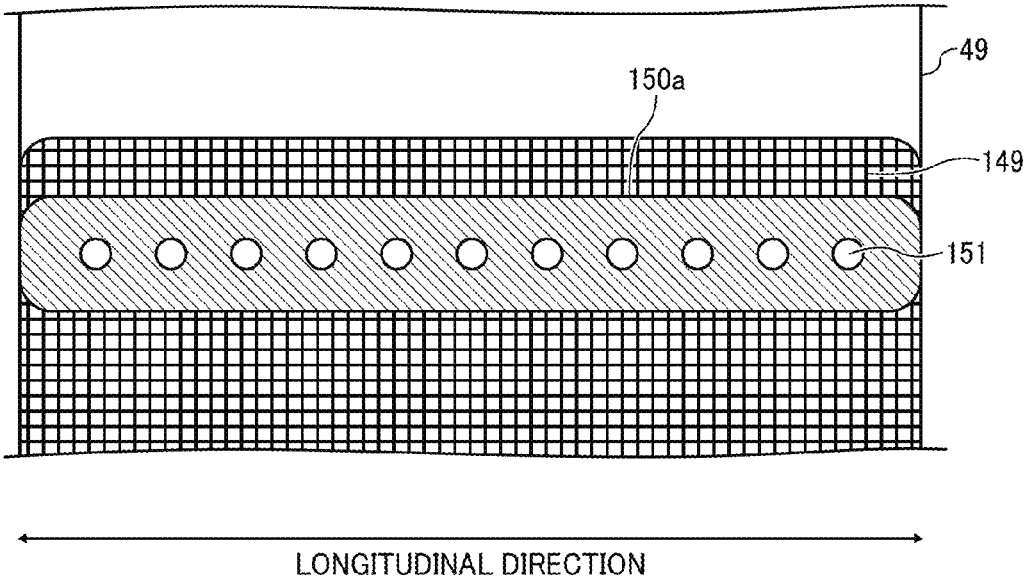
FIG. 13 is a plan view of the slide sheet depicted in FIG. 12 and a first washer plate mounted on the slide sheet.

FIG. 11 is a schematic vertical cross-sectional view of a fixing device 40U incorporating the gap retainer 80U. FIG. 12 is a plan view of a slide sheet 149 incorporated in the fixing device 40U. FIG. 13 is a plan view of the slide sheet 149 wound around the presser 49 and a first washer plate 150*a* mounted on the slide sheet 149, illustrating a belt side thereof, which is disposed opposite the fixing belt 43.

As illustrated in FIG. 11, the gap retainer 80U includes the slide sheet 149 serving as a friction reducer sandwiched between the pressing portion 49*b* of the presser 49 and the inner circumferential surface of the fixing belt 43. For example, the slide sheet 149 is a narrow, rectangular strip of cloth (e.g., fabric) weaved with fiber made of resin such as polytetrafluoroethylene (PTFE). The slide sheet 149 is adhered with a lubricant such as silicone oil. The slide sheet 149 is interposed between the inner circumferential surface of the fixing belt 43 and the pressing portion 49*b* of the presser 49, facilitating sliding of the fixing belt 43 over the slide sheet 149. The slide sheet 149 is wound around the presser 49 such that the slide sheet 149 covers a belt side face 49*g* of the presser 49 that is disposed opposite the fixing belt 43. The slide sheet 149 is folded back at the front edge of the presser 49. The slide sheet 149 is wound around the presser 49 such that the slide sheet 149 covers a roller side face 49*h* of the presser 49 that is disposed opposite the fixing roller 41.

As illustrated in FIG. 12, the slide sheet 149 is made of fabric constructed of warp and weft that form a grid. The grid includes a plurality of recesses 149*a* and a plurality of projections 149*b*. The recess 149*a* has no thread. The projection 149*b* is produced by the warp and the weft layered on the warp. The lubricant accumulates in the recesses 149*a* and does not dry up over time, facilitating sliding of the fixing belt 43 over the slide sheet 149 constantly. Thus, the slide sheet 149 includes a surface layer 149*c* that is uneven and constructed of the recesses 149*a* and the projections 149*b*.

As illustrated in FIG. 13, the first washer plate 150*a* includes a plurality of through holes aligned in the axial direction of the fixing roller 41 parallel to a longitudinal direction of the presser 49 with an identical interval between the adjacent through holes. A plurality of fasteners 151 (e.g., a bolt and a screw) is inserted into the plurality of through holes, respectively. As illustrated in an enlarged part of the fixing device 40U indicated by a dotted circle in FIG. 11, the first washer plate 150*a* is provided with a plurality of through holes 152. A second washer plate 150*b* is provided with a plurality of holes 153. An interior wall of the through hole 152 mounts an internal thread 152*a* (e.g., a female thread). The fastener 151 is inserted into the through hole 152 of the first washer plate 150*a*, a through hole 154 of the slide sheet 149, a through hole 155 of the presser 49, a through hole 154 of the slide sheet 149, and the hole 153 of the second washer plate 150*b*. The fastener 151 is turned along the internal thread 152*a* of the through hole 152 of the first washer plate 150*a* and fastened. Thus, both ends of the slide sheet 149 are sandwiched and secured between the first washer plate 150*a* and the second washer plate 150*b*.

If the slide sheet 149 is attached to the belt side face 49*g* of the pressing portion 49*b* of the presser 49, the slide sheet 149 facilitates sliding of the fixing belt 43 over the slide sheet 149. However, if the slide sheet 149 is attached to the belt side face 49*g* of the pressing portion 49*b* of the presser 49 that is disposed opposite the fixing belt 43, the slide sheet 149 is secured to the presser 49 by being adhered to the pressing portion 49*b* of the presser 49 with double-sided adhesive tape or the like. Accordingly, as the inner circumferential surface of the fixing belt 43 slides over the slide sheet 149, the fixing belt 43 exerts a force to the slide sheet 149 in the rotation direction D43 of the fixing belt 43. Hence, the slide sheet 149 may peel off the presser 49. To address this circumstance, the fixing device 40U incorporates the slide sheet 149 that is folded back at the front edge of the presser 49 and is attached to the roller side face 49*h* of the presser 49 that is disposed opposite the fixing roller 41. Additionally, as illustrated in the enlarged part of the fixing device 40U that is indicated by the dotted circle in FIG. 11, the first washer plate 150*a*, the second washer plate 150*b*, and the fastener 151 secure both ends of the slide sheet 149 to the presser 49 stably. Thus, the first washer plate 150*a*, the second washer plate 150*b*, and the fastener 151 prevent the slide sheet 149 from peeling off the belt side face 49*g* of the presser 49 that is disposed opposite the inner circumferential surface of the fixing belt 43.

As illustrated in FIG. 11, since the slide sheet 149 is wound around the presser 49, the slide sheet 149 is sandwiched between the pressing portion 49*b* of the presser 49 and the inner circumferential surface of the fixing belt 43. Accordingly, compared to a configuration in which the pressing portion 49*b* of the presser 49 contacts the inner circumferential surface of the fixing belt 43 directly, the slide sheet 149 sandwiched between the presser 49 and the fixing belt 43 reduces sliding friction of the fixing belt 43, while the fixing belt 43 slides over the presser 49, reduces a driving torque of the fixing belt 43, and suppresses abrasion of the inner circumferential surface of the fixing belt 43.

The slide sheet 149 is a sheet having a reduced friction resistance such as a PFA sheet and a PTFE sheet. If the slide sheet 149 made of the sheet having the reduced friction resistance has an uneven thickness, pressure exerted by the fixing belt 43 to the surface layer 149*c*, that is, a slide face, of the slide sheet 149 over which the fixing belt 43 slides is uneven. Accordingly, a portion of the slide sheet 149 that receives relatively great pressure may suffer from local degradation. To address this circumstance, the slide sheet 149 has an even thickness. For example, the thickness of the slide sheet 149 is 500 micrometers plus-and-minus 100 micrometers. However, if the slide sheet 149 contacts the fixing roller 41, the slide sheet 149 may degrade rotation of the fixing roller 41, increasing the load torque imposed on the fixing roller 41 and shortening the life of the fixing roller 41 and the slide sheet 149. To address this circumstance, the slide sheet 149 has a thickness that prevents the slide sheet 149 from coming into contact with the fixing roller 41 at the border N2*s*. The slide sheet 149 is made of a material that reduces the coefficient of friction with the inner circumferential surface of the fixing belt 43 compared to a material of the presser 49 at least. Alternatively, a low-friction material may coat the belt side face 49*g* of the pressing portion 49*b* of the presser 49 that is disposed opposite the fixing belt 43 to produce a low-friction layer on the presser 49.

As described above, if a part of the presser 49 around which the slide sheet 149 is wound contacts the fixing belt 43 directly while the fixing belt 43 rotates, the presser 49 may degrade rotation of the fixing belt 43 or may cause the outer circumferential surface of the fixing belt 43 to suffer from abrasion. To address this circumstance, the presser 49 is requested to be isolated from the fixing belt 43. In the fixing device 40U depicted in FIG. 11, a length of the slide sheet 149 is not smaller than a length of the pressing portion 49*b* of the presser 49 in the rotation direction D43 of the fixing belt 43. A width of the slide sheet 149 is not smaller than a width of the presser 49 in the longitudinal direction thereof perpendicular to the rotation direction D43 of the fixing belt 43. Accordingly, the slide sheet 149 covers the presser 49 and prevents exposure of the presser 49. Even if the pressure roller 45 presses the fixing belt 43 against the presser 49, the fixing belt 43 does not contact the presser 49. Consequently, the presser 49 made of metal and the fixing belt 43 made of rubber are immune from abrasion.

A hardness of the slide sheet 149 is smaller than a hardness of the presser 49. Accordingly, the slide sheet 149 suppresses abrasion of the fixing belt 43 compared to a configuration in which the slide sheet 149 has a hardness not smaller than the hardness of the presser 49 and is sandwiched between the presser 49 and the inner circumferential surface of the fixing belt 43.

The above describes the exemplary embodiments of the fixing devices 40, 40S, 40T, and 40U installed in the image forming apparatus 1000 such as a copier, a printer, a facsimile machine, and an MFP that forms a toner image T on a sheet P by electrophotography. Alternatively, the exemplary embodiments of the fixing devices 40, 40S, 40T, and 40U may be applied to a fixing device that dries an ink image formed on a sheet with ink and is installed in an image forming apparatus such as a copier, a printer, a facsimile machine, and an MFP that forms an ink image on a sheet by an inkjet printing system, for example.

The exemplary embodiments described above are one example of a fixing device (e.g., the fixing devices 40, 40S, 40T, and 40U) and attain advantages below in a plurality of aspects 1 to 25.

A description is provided of advantages of the fixing device in the aspect 1.

As illustrated in FIGS. 2, 5, 7, 8, and 11, the fixing device includes a fixing belt (e.g., the fixing belt 43), a nip former (e.g., the fixing roller 41), a pressure rotator (e.g., the pressure roller 45), a heater (e.g., the heater 44), a presser (e.g., the presser 49), and a gap retainer (e.g., the gap retainers 80, 80S, 80T, and 80U).

The fixing belt 43 is an endless belt stretched taut across a plurality of stretchers and rotatable in a rotation direction (e.g., the rotation direction D43). The fixing roller 41 serves as a nip former and one of the plurality of stretchers that stretches the fixing belt. The pressure roller 45 serves as a pressure rotator disposed opposite the nip former via the fixing belt and pressed against the nip former via the fixing belt to form a fixing nip (e.g., the fixing nip N1) between the fixing belt and the pressure rotator. A recording medium (e.g., a sheet P) is conveyed through the fixing nip. The heater 44 serves as a heater that heats the fixing belt. The presser 49 serves as a presser disposed downstream from an exit (e.g., the exit N1*e*) of the fixing nip in a recording medium conveyance direction (e.g., the sheet conveyance direction DP). The presser brings the fixing belt into contact with the pressure rotator or presses the fixing belt against the pressure rotator. The gap retainer contacts the nip former and is coupled to the presser to retain a gap between the nip former and the presser, thus retaining isolation of the presser from the nip former.

Accordingly, even if the nip former expands thermally, the gap retainer retains the gap between the nip former and the presser, thus retaining isolation of the presser from the nip former. Consequently, the presser does not damage an outer circumferential surface of the nip former.

A description is provided of advantages of the fixing device in the aspect 2.

According to the aspect 1, as illustrated in FIGS. 5, 7, 8, and 11, the gap retainer includes an abutment (e.g., the abutment 82) that contacts the outer circumferential surface of the nip former. The abutment moves in accordance with movement or change of the outer circumferential surface of the nip former in a normal direction to the outer circumferential surface of the nip former so as to move the presser in the recording medium conveyance direction.

Accordingly, as the outer circumferential surface of the nip former moves toward the presser due to thermal expansion of the nip former or the like, the abutment moves toward the presser. In accordance with movement of the abutment, the gap retainer moves the presser in a separation direction in which the presser separates from the nip former. Thus, the gap retainer secures the gap between the presser and the outer circumferential surface of the nip former.

A description is provided of advantages of the fixing device in the aspect 3.

According to the aspect 2, the presser includes a shaft (e.g., the shaft 49*c*) about which the presser pivots so that the gap retainer and the presser pivot together in accordance with movement of the abutment that is moved by the outer circumferential surface of the nip former in the normal direction to the outer circumferential surface of the nip former.

Accordingly, as described in the exemplary embodiments, the presser moves in accordance with movement of the abutment.

A description is provided of advantages of the fixing device in the aspect 4.

According to the aspect 3, the gap retainer further includes another abutment (e.g., the abutment 82) that contacts the outer circumferential surface of the nip former.

The abutment and the another abutment overlap in an identical span in a circumferential direction of the nip former. Accordingly, as described in the exemplary embodiments, a distance from the abutment to the shaft of the presser is equivalent to a distance from the another abutment to the shaft of the presser in the circumferential direction of the nip former. The abutment contacts one lateral end of the nip former in an axial direction thereof. The another abutment contacts another lateral end of the nip former in the axial direction thereof. A pivot angle of the gap retainer and the presser that are pivoted by the abutment is substantially equivalent to a pivot angle of the gap retainer and the presser that are pivoted by the another abutment. Hence, no difference in the pivot angle of the gap retainer and the presser generates throughout the entire span of the presser in the axial direction of the nip former, preventing warping of the presser elongated in the axial direction of the nip former.

A description is provided of advantages of the fixing device in the aspect 5.

According to the aspect 3 or 4, the gap retainer is not deformed resiliently by pressure exerted from the abutment as the nip former expands thermally. Accordingly, as described in the exemplary embodiments, movement of the abutment in accordance with movement of the nip former in the normal direction to the outer circumferential surface of the nip former is not absorbed by resilient deformation of the gap retainer. Consequently, the presser moves in accordance with movement of the abutment, securing the gap between the presser and the nip former precisely.

A description is provided of advantages of the fixing device in the aspect 6.

According to any one of the aspects 2 to 5, as illustrated in FIG. 7, the gap retainer includes a biasing member (e.g., the spring 83) that biases the presser toward the nip former. As described above as the first variation of the gap retainer, when the temperature of the nip former decreases and thermal expansion of the nip former decreases, a bias of the biasing member pivots the presser in an opposite direction opposite the separation direction in which the presser separates from the nip former while the nip former expands thermally.

Accordingly, as described in the exemplary embodiments, the presser prevents enlargement of the border N2*s* interposed between nips (e.g., the fixing nip N1 and the post nip N2) where the fixing belt and the pressure rotator sandwich the recording medium. For example, as an amount of heat generated by the heater is adjusted according to the thermal capacity of the recording medium, a length of the border N2*s* produced when the temperature of the fixing nip N1 and thermal expansion of the nip former increase to fix a toner image on thick paper is equivalent to a length of the border N2*s* produced when the temperature of the fixing nip N1 and thermal expansion of the nip former decrease to fix a toner image on thin paper.

Accordingly, even when thin paper is used as the recording medium, generation of steam is suppressed at the border N2*s*, thus suppressing generation of air bubbles between the fixing belt and the recording medium. Consequently, air bubbles do not move around on the recording medium conveyed through the post nip N2 where the presser presses the recording medium against the pressure rotator, thus suppressing variation in gloss of the toner image on the recording medium.

A description is provided of advantages of the fixing device in the aspect 7.

According to any one of the aspects 2 to 6, as illustrated in FIG. 5, the abutment includes a contact face (e.g., the contact face 82*a*) that contacts the nip former. The contact face includes a plane or a curve curved along the outer circumferential surface of the nip former.

Accordingly, as described in the exemplary embodiments, the abutment moves precisely in accordance with movement of the nip former in the normal direction to the outer circumferential surface of the nip former.

A description is provided of advantages of the fixing device in the aspect 8.

According to any one of the aspects 2 to 7, as illustrated in FIG. 6, the abutment contacts the nip former in a non-conveyance span (e.g., the non-conveyance span NS) in the axial direction of the nip former where the recording medium is not conveyed over the fixing belt.

Accordingly, as described in the exemplary embodiments, even if the nip former suffers from abrasion in the non-conveyance span where the nip former contacts the abutment due to sliding of the nip former over the abutment, abrasion of the nip former does not adversely affect fixing performance of the fixing device.

A description is provided of advantages of the fixing device in the aspect 9.

According to the aspect 8, as illustrated in FIG. 6, the abutment is disposed at each lateral end of the gap retainer and in contact with each lateral end of the nip former in the axial direction thereof.

Accordingly, as described above in the exemplary embodiments, the abutment causes the presser to move in accordance with movement of the outer circumferential surface of the nip former in the normal direction thereto throughout the entire span of the presser in the axial direction of the nip former, preventing the presser from coming into contact with the outer circumferential surface of the nip former precisely.

A description is provided of advantages of the fixing device in the aspect 10.

According to any one of the aspects 2 to 9, as illustrated in FIGS. 5, 7, 8, and 11, the gap retainer, except for the abutment, does not contact the nip former.

Accordingly, as described in the exemplary embodiments, the gap retainer suppresses increase in a load imposed on the nip former while the nip former rotates, suppressing degradation in the life of the nip former.

A description is provided of advantages of the fixing device in the aspect 11.

According to any one of the aspects 2 to 10, the contact face of the abutment has a reduced coefficient of friction. For example, a coefficient of friction between the contact face of the abutment and the nip former is smaller than a coefficient of friction of other portion of the gap retainer.

Accordingly, as described in the exemplary embodiments, the abutment suppresses abrasion of a contact portion of the nip former that contacts the abutment.

A description is provided of advantages of the fixing device in the aspect 12.

According to any one of the aspects 2 to 11, as illustrated in FIG. 8, a resilient member (e.g., the compression spring 85) is interposed between the abutment and the presser.

Accordingly, as described as the second variation of the gap retainer, the resilient member moves the presser in accordance with movement of the abutment moved by the nip former in the normal direction to the outer circumferential surface of the nip former. Consequently, the resilient member moves the presser in accordance with movement or change of the outer circumferential surface of the nip former in the normal direction thereto precisely. Additionally, even if a distance from the presser to the abutment changes due to change in an amount of engagement of the pressure rotator with the nip former via the fixing belt, the resilient member deforms resiliently to contact the abutment and the presser constantly. Accordingly, even if the distance from the presser to the abutment changes due to change in the amount of engagement of the pressure rotator with the nip former via the fixing belt, the resilient member moves the presser in accordance with movement of the abutment moved by the nip former in the normal direction to the outer circumferential surface of the nip former.

A description is provided of advantages of the fixing device in the aspect 13.

According to any one of the aspects 1 to 12, as illustrated in FIGS. 5, 7, 8, and 11, the gap retainer is isolated from the fixing belt.

Accordingly, as described in the exemplary embodiments, the fixing belt, while rotating in the rotation direction, does not frictionally move the gap retainer in the rotation direction of the fixing belt. Hence, the gap retainer does not move the presser in the separation direction in which the presser separates from the nip former, suppressing enlargement of the border N2*s*.

A description is provided of advantages of the fixing device in the aspect 14.

According to any one of the aspects 1 to 13, as illustrated in FIGS. 5, 7, 8, and 11, a separator (e.g., the separation aid 48) is disposed downstream from the nip former in the recording medium conveyance direction. The separator is isolated from the pressure rotator via the fixing belt. The separator contacts an inner circumferential surface of the fixing belt to increase a curvature of the fixing belt.

Accordingly, as described above in the exemplary embodiments, a curvature of the separator separates a soft recording medium such as thin paper and a recording medium bearing a toner image extending to a leading end of the recording medium, which are not separated from the fixing belt by the curvature of the fixing belt at an exit of the post nip formed between the fixing belt and the pressure rotator by the presser pressing the fixing belt against the pressure rotator. Since the separator is isolated from the pressure rotator via the fixing belt, the separator improves durability of the pressure rotator as described above in the exemplary embodiments.

A description is provided of advantages of the fixing device in the aspect 15.

According to any one of the aspects 1 to 14, the presser includes a resilient plate.

Accordingly, as described above in the exemplary embodiments, compared to a configuration in which the presser is a block, the presser made of the resilient plate attains a reduced thermal capacity. Thus, the presser draws less heat from the fixing belt and thereby suppresses waste of heat. Accordingly, compared to the configuration in which the presser is the block, the presser made of the resilient plate shortens a waiting time for a user to wait until the fixing belt is heated to a target temperature. Additionally, compared to the configuration in which the presser is the block, the presser made of the resilient plate suppresses power consumption, saving energy.

Since the presser is resilient, the presser deforms readily to curve along an outer circumferential surface of the pressure rotator precisely, thus pressing the fixing belt against the pressure rotator precisely.

A description is provided of advantages of the fixing device in the aspect 16.

According to any one of the aspects 1 to 15, as illustrated in FIG. 11, a friction reducer (e.g., the slide sheet 149) is sandwiched between the presser and the fixing belt. A coefficient of friction between the friction reducer and the inner circumferential surface of the fixing belt is smaller than a coefficient of friction between the presser and the inner circumferential surface of the fixing belt depicted in FIG. 5.

Accordingly, as described above as the third variation of the gap retainer, compared to a configuration in which the presser contacts the inner circumferential surface of the fixing belt directly, the friction reducer sandwiched between the presser and the fixing belt reduces sliding friction of the fixing belt as the fixing belt slides over the presser via the friction reducer. Consequently, the friction reducer reduces abrasion of the inner circumferential surface of the fixing belt and a load torque imposed on the fixing belt.

A description is provided of advantages of the fixing device in the aspect 17.

According to the aspect 16, as illustrated in FIG. 11, the presser includes a belt side face (e.g., the belt side face 49*g*) disposed opposite the inner circumferential surface of the fixing belt. The belt side face of the presser presses against the inner circumferential surface of the fixing belt in a pressing span (e.g., the pressing span S49) in the rotation direction of the fixing belt. A length of the friction reducer is not smaller than the pressing span of the presser in the rotation direction of the fixing belt.

Accordingly, as described as the third variation of the gap retainer, the friction reducer suppresses exposure of the presser. Even if the pressure rotator presses the fixing belt against the presser, the fixing belt does not contact the presser because the presser is not exposed. Consequently, the friction reducer suppresses abrasion of the presser and the fixing belt.

A description is provided of advantages of the fixing device in the aspect 18.

According to the aspect 16 or 17, a length of the friction reducer is not smaller than the pressing span of the presser in a direction perpendicular to the rotation direction of the fixing belt.

Accordingly, as described as the third variation of the gap retainer, the friction reducer suppresses exposure of the presser. Even if the pressure rotator presses the fixing belt against the presser, the fixing belt does not contact the presser because the presser is not exposed. Consequently, the friction reducer suppresses abrasion of the presser and the fixing belt.

A description is provided of advantages of the fixing device in the aspect 19.

According to any one of the aspects 16 to 18, as illustrated in FIG. 11, the friction reducer does not contact the nip former.

Accordingly, as described above as the third variation of the gap retainer, since the friction reducer is isolated from the nip former, the friction reducer may not degrade rotation of the nip former, preventing increase in the load torque imposed on the nip former and shortening of the life of the nip former and the friction reducer.

A description is provided of advantages of the fixing device in the aspect 20.

According to any one of the aspects 16 to 19, a hardness of the friction reducer is smaller than a hardness of the presser.

Accordingly, as described as the third variation of the gap retainer, since the hardness of the friction reducer is smaller than the hardness of the presser, the friction reducer suppresses abrasion of the fixing belt compared to a configuration in which the friction reducer has the hardness not smaller than the hardness of the presser and is sandwiched between the presser and the inner circumferential surface of the fixing belt.

A description is provided of advantages of the fixing device in the aspect 21.

According to any one of the aspects 16 to 20, the friction reducer is made of fabric.

Accordingly, as described as the third variation of the gap retainer, the friction reducer is made of fabric constructed of warp and weft that form a grid. As illustrated in FIG. 12, the grid includes a plurality of recesses (e.g., the recesses 149*a*) and a plurality of projections (e.g., the projections 149*b*).

The recess has no thread. The projection is produced by the warp and the weft layered on the warp. A lubricant accumulates in the recess and does not dry up over time, facilitating sliding of the fixing belt over the friction reducer constantly.

A description is provided of advantages of the fixing device in the aspect 22.

According to any one of the aspects 16 to 21, as illustrated in FIG. 12, the friction reducer includes a surface layer (e.g., the surface layer 149*c*) that includes the recess and the projection and is uneven.

Accordingly, as described as the third variation of the gap retainer, the lubricant accumulates in the recess and does not dry up over time, facilitating sliding of the fixing belt over the friction reducer constantly.

A description is provided of advantages of the fixing device in the aspect 23.

According to any one of the aspects 16 to 22, the friction reducer is adhered with the lubricant.

Accordingly, as described as the third variation of the gap retainer, the friction reducer facilitates sliding of the fixing belt over the friction reducer.

A description is provided of advantages of the fixing device in the aspect 24.

According to any one of the aspects 16 to 20, the friction reducer includes a sheet that reduces friction between the friction reducer and the fixing belt and has an even thickness.

Accordingly, as described as the third variation of the gap retainer, the friction reducer prevents the fixing belt from exerting pressure unevenly onto a slide face, that is, the surface layer, of the friction reducer over which the fixing belt slides, thus preventing a portion of the friction reducer that receives relatively great pressure from suffering from local degradation.

A description is provided of advantages of an image forming apparatus incorporating the fixing device in the aspect 25.

As illustrated in FIG. 1, an image forming apparatus (e.g., the image forming apparatus 1000) includes an image forming device (e.g., the image forming units 2Y, 2M, 2C, and 2K) that forms a toner image. The image forming device includes a latent image bearer (e.g., the photoconductors 3Y, 3M, 3C, and 3K), a charger (e.g., the charger 5Y), an optical writing unit (e.g., the optical writing units 1YM and 1CK), and a developing device (e.g., the developing device 4Y). The image forming apparatus further includes a transfer device (e.g., the primary transfer unit 60 and the secondary transfer unit 78) to transfer the toner image formed on the latent image bearer onto a recording medium (e.g., a sheet P). The image forming apparatus further includes a fixing device (e.g., the fixing devices 40, 40S, 40T, and 40U) according to any one of the aspects 1 to 24 to fix the toner image on the recording medium.

Accordingly, the image forming apparatus incorporates the fixing device attaining an improved durability.

According to the exemplary embodiments described above, the fixing belt 43 serves as a fixing belt. Alternatively, a fixing film, a fixing sleeve, or the like may be used as a fixing belt. Further, the pressure roller 45 serves as a pressure rotator. Alternatively, a pressure belt or the like may be used as a pressure rotator.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present invention.

Any one of the above-described operations may be performed in various other ways, for example, in an order different from the one described above.

What is claimed is:

1. A fixing device comprising:

a fixing belt that is endless and rotatable in a rotation direction;

a nip former stretching the fixing belt;

a pressure rotator to press against the nip former via the fixing belt to form a fixing nip between the fixing belt and the pressure rotator, the fixing nip through which a recording medium is conveyed;

a presser, disposed downstream from an exit of the fixing nip in a recording medium conveyance direction, to bring the fixing belt into contact with the pressure rotator;

a gap retainer contacting the nip former and being coupled to the presser to retain isolation of the presser from the nip former: and a separator being disposed downstream from the presser in the rotation direction of the fixing belt, the separator supporting the presser, and the separator being disposed opposite the pressure rotator via the fixing belt and being isolated from the pressure rotator.

2. The fixing device according to claim 1, wherein the gap retainer includes an abutment contacting an outer circumferential surface of the nip former, the abutment is movable with a movement of the outer circumferential surface of the nip former in a normal direction to the outer circumferential surface of the nip former so as to move the presser in the recording medium conveyance direction.

3. The fixing device according to claim 2, wherein the presser includes a shaft about which the presser pivots to pivot the gap retainer together with the presser in accordance with movement of the abutment moved in the normal direction to the outer circumferential surface of the nip former.

4. The fixing device according to claim 2, wherein the abutment includes a contact face contacting the nip former and including one of a plane and a curve curved along the outer circumferential surface of the nip former.

5. The fixing device according to claim 2, wherein the abutment contacts the nip former in a non-conveyance span in an axial direction of the nip former where the recording medium is not conveyed over the fixing belt.

6. The fixing device according to claim 5, wherein the abutment contacts each lateral end of the nip former in the axial direction of the nip former.

7. The fixing device according to claim 1, wherein the gap retainer is isolated from the fixing belt.

8. The fixing device according to claim 1, wherein the presser includes a resilient plate.

9. The fixing device according to claim 1, further comprising a friction reducer sandwiched between the presser and the fixing belt, the friction reducer to reduce a coefficient of friction between the friction reducer and an inner circumferential surface of the fixing belt.

10. The fixing device according to claim 9, wherein the presser includes a belt side face disposed opposite the inner circumferential surface of the fixing belt, wherein the belt side face of the presser presses against the inner circumferential surface of the fixing belt via the friction reducer in a pressing span in the rotation direction of the fixing belt, and wherein a length of the friction reducer is not smaller than the pressing span of the presser in the rotation direction of the fixing belt.

11. The fixing device according to claim 9, wherein the presser includes a belt side face disposed opposite the inner circumferential surface of the fixing belt, wherein the belt side face of the presser presses against the inner circumferential surface of the fixing belt via the friction reducer in a pressing span in the rotation direction of the fixing belt, and wherein a length of the friction reducer is not smaller than the pressing span of the presser in a direction perpendicular to the rotation direction of the fixing belt.

12. The fixing device according to claim 9, wherein the friction reducer is isolated from the nip former.

13. The fixing device according to claim 9, wherein a hardness of the friction reducer is smaller than a hardness of the presser.

14. The fixing device according to claim 9, wherein the friction reducer is made of fabric.

15. The fixing device according to claim 9, wherein the friction reducer includes a surface layer including:

a projection; and a recess adhered with a lubricant.

16. The fixing device according to claim 9, wherein the friction reducer includes a sheet that reduces friction between the friction reducer and the fixing belt and has an even thickness.

17. A fixing device comprising:

a fixing belt that is endless and rotatable in a rotation direction;

a nip former stretching the fixing belt;

a pressure rotator to press against the nip former via the fixing belt to form a fixing nip between the fixing belt and the pressure rotator, the fixing nip through which a recording medium is conveyed;

a presser, disposed downstream from an exit of the fixing nip in a recording medium conveyance direction, to bring the fixing belt into contact with the pressure rotator; and a gap retainer contacting the nip former and being coupled to the presser to retain isolation of the presser from the nip former, wherein the gap retainer includes an abutment contacting an outer circumferential surface of the nip former, the abutment to move in accordance with movement of the outer circumferential surface of the nip former in a normal direction to the outer circumferential surface of the nip former so as to move the presser in the recording medium conveyance direction, wherein the presser includes a shaft about which the presser pivots to pivot the gap retainer together with the presser in accordance with movement of the abutment moved in the normal direction to the outer circumferential surface of the nip former, wherein the gap retainer further includes another abutment contacting the outer circumferential surface of the nip former, and wherein the abutment and the another abutment overlap in an identical span in a circumferential direction of the nip former.

18. A fixing device comprising:

a fixing belt that is endless and rotatable in a rotation direction;

a nip former stretching the fixing belt;

a pressure rotator to press against the nip former via the fixing belt to form a fixing nip between the fixing belt and the pressure rotator, the fixing nip through which a recording medium is conveyed;

a presser, disposed downstream from an exit of the fixing nip in a recording medium conveyance direction, to bring the fixing belt into contact with the pressure rotator; and a gap retainer contacting the nip former and being coupled to the presser to retain isolation of the presser from the nip former, wherein the gap retainer includes an abutment contacting an outer circumferential surface of the nip former, the abutment to move in accordance with movement of the outer circumferential surface of the nip former in a normal direction to the outer circumferential surface of the nip former so as to move the presser in the recording medium conveyance direction, and wherein the gap retainer further includes a biasing member to bias the presser toward the nip former.

19. A fixing device comprising:

a fixing belt that is endless and rotatable in a rotation direction;

a nip former stretching the fixing belt;

a pressure rotator to press against the nip former via the fixing belt to form a fixing nip between the fixing belt and the pressure rotator, the fixing nip through which a recording medium is conveyed;

a presser, disposed downstream from an exit of the fixing nip in a recording medium conveyance direction, to bring the fixing belt into contact with the pressure rotator;

a gap retainer contacting the nip former and being coupled to the presser to retain isolation of the presser from the nip former, wherein the gap retainer includes an abutment contacting an outer circumferential surface of the nip former, the abutment to move in accordance with movement of the outer circumferential surface of the nip former in a normal direction to the outer circumferential surface of the nip former so as to move the presser in the recording medium conveyance direction; and a resilient member interposed between the abutment and the presser.

20. An image forming apparatus comprising:

an image forming device to form a toner image; and a fixing device disposed downstream from the image forming device in a recording medium conveyance direction to fix the toner image on a recording medium, the fixing device comprising:

a fixing belt that is endless and rotatable in a rotation direction;

a nip former stretching the fixing belt;

a pressure rotator to press against the nip former via the fixing belt to form a fixing nip between the fixing belt and the pressure rotator, the fixing nip through which a recording medium is conveyed;

a presser, disposed downstream from an exit of the fixing nip in a recording medium conveyance direction, to bring the fixing belt into contact with the pressure rotator;

a gap retainer contacting the nip former and being coupled to the presser to retain isolation of the presser from the nip former: and a separator being disposed downstream from the presser in the rotation direction of the fixing belt, the separator supporting the presser, and the separator being disposed opposite the pressure rotator via the fixing belt and being isolated from the pressure rotator.

* * * * *